US009857709B2

(12) United States Patent
Watanabe et al.

(10) Patent No.: US 9,857,709 B2
(45) Date of Patent: *Jan. 2, 2018

(54) TONER AND DEVELOPER

(75) Inventors: Naohiro Watanabe, Shizuoka (JP); Tsuyoshi Sugimoto, Shizuoka (JP); Mamoru Hozumi, Miyagi (JP); Tomoyuki Sato, Kanagawa (JP); Shinya Hanatani, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 612 days.

This patent is subject to a terminal disclaimer.

(21) Appl. No.: 13/822,433

(22) PCT Filed: Sep. 15, 2011

(86) PCT No.: PCT/JP2011/071761

§ 371 (c)(1),
(2), (4) Date: Mar. 12, 2013

(87) PCT Pub. No.: WO2012/046584

PCT Pub. Date: Apr. 12, 2012

(65) Prior Publication Data

US 2013/0177846 A1 Jul. 11, 2013

(30) Foreign Application Priority Data

Oct. 4, 2010 (JP) ..... 2010-224787
Jul. 1, 2011 (JP) ..... 2011-146993

(51) Int. Cl.
*G03G 9/087* (2006.01)
*G03G 9/08* (2006.01)

(52) U.S. Cl.
CPC ..... *G03G 9/08755* (2013.01); *G03G 9/081* (2013.01); *G03G 9/0804* (2013.01);
(Continued)

(58) Field of Classification Search
CPC ..... G03G 9/08755; G03G 9/08797; G03G 9/08795
(Continued)

(56) References Cited

U.S. PATENT DOCUMENTS 7,449,273 B2 11/2008 Ohki et al.
7,459,255 B2 12/2008 Tanaka et al.
(Continued)

FOREIGN PATENT DOCUMENTS

CN 101846899 A 9/2010
JP 08-176310 7/1996
(Continued)

OTHER PUBLICATIONS

International Search Report dated Dec. 20, 2011 in PCT/JP11/071761 Filed Sep. 15, 2011.
(Continued)

*Primary Examiner* — Hoa V Le
(74) *Attorney, Agent, or Firm* — Oblon, McClelland, Maier & Neustadt, L.L.P.

(57) ABSTRACT

To provide a toner, containing: a binder resin; a colorant; a releasing agent; and a crystalline polyester resin, wherein the toner satisfies the following formulae (1) to (3): 40° C.≤X≤55° C. Formula (1) 85° C.≤Y≤92° C. Formula (2) 35° C.≤Y−X≤50° C. Formula (3) where X is an onset temperature and Y is an endset temperature of an endothermic peak on a differential scanning calorimetry (DSC) curve of the toner as measured by a differential scanning calorimeter (DSC).

15 Claims, 1 Drawing Sheet

(52) U.S. Cl.
CPC ..... *G03G 9/0806* (2013.01); *G03G 9/0821* (2013.01); *G03G 9/08782* (2013.01); *G03G 9/08795* (2013.01); *G03G 9/08797* (2013.01)

(58) Field of Classification Search
USPC ..... 430/109.4
See application file for complete search history.

(56) References Cited

U.S. PATENT DOCUMENTS

| | | | | |
|---|---|---|---|---|
| 7,718,339 | B2 | 5/2010 | Tomita et al. | |
| 8,216,754 | B2 * | 7/2012 | Ikeda et al. | 430/108.1 |
| 2005/0042534 | A1 | 2/2005 | Tanaka et al. | |
| 2005/0214670 | A1 | 9/2005 | Matsumoto et al. | |
| 2006/0046174 | A1 * | 3/2006 | Ohki et al. | 430/108.4 |
| 2006/0057487 | A1 | 3/2006 | Nagayama et al. | |
| 2006/0057488 | A1 | 3/2006 | Inoue et al. | |
| 2006/0063089 | A1 * | 3/2006 | Tanaka et al. | 430/110.3 |
| 2006/0160011 | A1 * | 7/2006 | Inoue et al. | 430/109.4 |
| 2007/0218388 | A1 | 9/2007 | Kurose et al. | |
| 2007/0218390 | A1 | 9/2007 | Nozaki et al. | |
| 2007/0218396 | A1 | 9/2007 | Tomita | |
| 2008/0096119 | A1 | 4/2008 | Yamamoto et al. | |
| 2008/0102393 | A1 | 5/2008 | Hasegawa | |
| 2008/0187854 | A1 * | 8/2008 | Yoshida et al. | 430/109.4 |
| 2008/0254378 | A1 | 10/2008 | Matsumoto et al. | |
| 2009/0075195 | A1 | 3/2009 | Shu et al. | |
| 2009/0233210 | A1 * | 9/2009 | Ninomiya et al. | 430/109.4 |
| 2009/0286176 | A1 * | 11/2009 | Ohmura et al. | 430/107.1 |
| 2010/0055595 | A1 * | 3/2010 | Shirai et al. | 430/109.4 |
| 2010/0055597 | A1 * | 3/2010 | Kamoto | 430/109.4 |
| 2010/0104967 | A1 * | 4/2010 | Ikeda et al. | 430/108.23 |
| 2010/0129748 | A1 | 5/2010 | Inoue et al. | |
| 2010/0216068 | A1 | 8/2010 | Kotsugai et al. | |
| 2010/0248123 | A1 * | 9/2010 | Iwanaga et al. | 430/109.4 |
| 2010/0310980 | A1 | 12/2010 | Sugimoto et al. | |
| 2011/0002719 | A1 | 1/2011 | Shu et al. | |
| 2011/0076612 | A1 | 3/2011 | Awamura et al. | |
| 2011/0223532 | A1 | 9/2011 | Sugimoto et al. | |
| 2011/0236812 | A1 * | 9/2011 | Ishihara et al. | 430/105 |
| 2011/0236813 | A1 * | 9/2011 | Kiyono et al. | 430/105 |
| 2011/0300477 | A1 * | 12/2011 | Yoshida et al. | 430/105 |
| 2012/0122027 | A1 | 5/2012 | Watanabe et al. | |

FOREIGN PATENT DOCUMENTS

| | | |
|---|---|---|
| JP | 2579150 | 11/1996 |
| JP | 11-133665 | 5/1999 |
| JP | 2001-158819 | 6/2001 |
| JP | 2002-287400 | 10/2002 |
| JP | 2002-351143 | 12/2002 |
| JP | 2004-151535 A | 5/2004 |
| JP | 2004-286842 | 10/2004 |
| JP | 2005-015589 | 1/2005 |
| JP | 2005-070759 | 3/2005 |
| JP | 2006-65015 | 3/2006 |
| JP | 2006-071906 | 3/2006 |
| JP | 2006-106699 | 4/2006 |
| JP | 2006-154872 | 6/2006 |
| JP | 2006-293338 | 10/2006 |
| JP | 2007-25525 | 2/2007 |
| JP | 2007-072333 | 3/2007 |
| JP | 2007-233169 | 9/2007 |
| JP | 4023119 | 10/2007 |
| JP | 2008-015230 | 1/2008 |
| JP | 2008-209489 A | 9/2008 |
| JP | 4347174 | 7/2009 |
| JP | 2010-77419 | 4/2010 |
| WO | 2006-035862 | 4/2006 |

OTHER PUBLICATIONS

Combined Chinese Office Action and Search Report dated Feb. 28, 2015 in Patent Application No. 201180058367.3 (with partial English language translation).

Office Action dated May 12, 2015 in Japanese Patent Application No. 2011-146993.

* cited by examiner

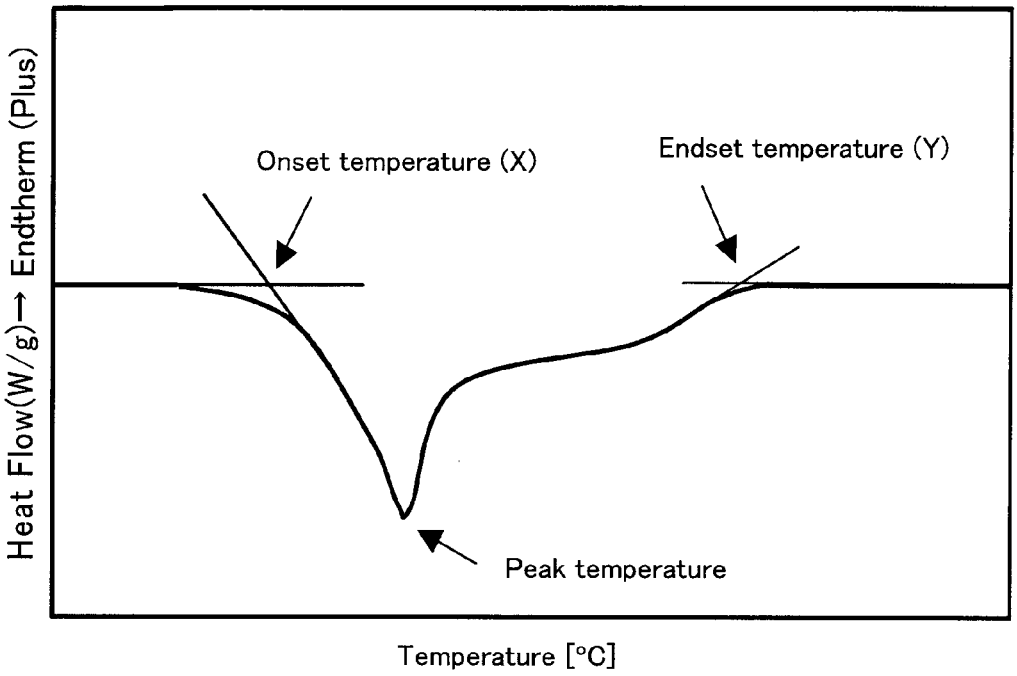
Onset temperature (X)
Endset temperature (Y)
Peak temperature
Heat Flow(W/g)→ Endtherm (Plus)
Temperature [°C]

TONER AND DEVELOPER

TECHNICAL FIELD

The present invention relates to a toner and a developer used for visualizing a latent electrostatic image in electrophotography, electrostatic recording, electrostatic printing, or the like.

BACKGROUND ART

Recently, demands in the market include to down size particles diameters of toners for improving image qualities of output images, and to improve low temperature fixing abilities of toners for energy saving.

A toner obtained by the conventional kneading-pulverizing method has irregular shapes with a broad particle size distribution, and it is difficult to obtain smaller particle diameters of a toner by such a method. Moreover, the toner obtained by this method has various problems, including the above, such as high energy requirements for fixing. Especially, during the fixing, the toner produced by the kneading-pulverizing method has a large amount of a releasing agent (wax) present at surfaces of toner particles, as the kneaded product is cracked at the surface of the releasing agent (the wax) by the pulverization to produce the toner particles. For this reason, the releasing effect is enhanced, but the toner tends to deposit on a carrier, a photoconductor, and a blade. Therefore, such the toner does not have satisfactory characteristics on the whole.

In order to solve the aforementioned problems in the kneading-pulverizing method, there has been proposed a production method of a toner by a polymerization method. The toner produced by this polymerization method can be easily made to have small particle diameters, and has a sharper particle size distribution than that of the toner obtained by the pulverization method, and has the wax encapsulated in the toner particles.

As the toner production method by such the polymerization method, there has been proposed a production method of a toner, in which an elongation reaction product of a urethane-modified polyester is used as a toner binder to produce a toner having a practical sphericity of 0.90 to 1.00 for the purpose of improving flowing ability, low temperature fixing ability, and hot offset resistance of the toner (see PTL1).

Moreover, there have been disclosed methods for producing a toner, which has excellent powder flow ability, and transfer ability in the case where particle diameters of the toner are reduced, as well as having excellent heat resistance storage stability, low temperature fixing ability, and hot offset resistance of the toner (see PTL2 and PTL3).

Furthermore, there have been disclosed methods of producing a toner, in which a toner binder having a stable molecular weight distribution is produced, and a maturing step is provided for attaining both low temperature fixing ability and offset resistance of the toner (see PTL4 and PTL5).

There has been also disclosed a method where crystalline polyester is introduced by a polymerization method for improving low temperature fixing ability of a toner. As a preparation method of a crystalline polyester dispersion liquid, for example, PTL6 discloses a preparation method of a dispersion liquid using a solvent for phase separation. By this proposed method, however, only a coarse dispersion liquid having a dispersed particle diameter of several tens micrometers to several hundreds micrometers is obtained.

This method cannot yield a dispersion liquid having a volume average particle diameter of 1.0 μm or smaller, which can be used for the production of the toner.

Moreover, in PTL7, reduction of particle diameters of a toner is attempted by mixing crystalline polyester alone into a solvent and heating and cooling the mixture, for the purpose attaining reduced particle diameters of dispersed crystalline polyester in a dispersion liquid. The resulting dispersion liquid is however not stable, which is not satisfactory.

Moreover, PTL8 discloses that crystalline polyester is used, and glass transition temperature thereof before and after thermofusion thereof is controlled in a certain range for attaining both low temperature fixing ability and heat resistance storage stability of a toner. This proposed method, however, does not achieve sufficient low temperature fixing ability of a toner.

Furthermore, PTL9 discloses that a toner having a clear endothermic peak at 50° C. to 100° C. in the process of the first elevation of the temperature, and has the peak area reduced in ⅓ or smaller in the process of the second elevation of the temperature on the differential scanning calorimetry curve of the toner as measured by differential scanning calorimeter (DSC) to achieve low fixing temperature, high transparency of printed images, and reducing sticking of images during double-sided printing. It is, however, does not achieve sufficient low temperature fixing ability of a toner.

The toner production methods proposed in PTL1, PTL2, and PTL3 include a step of increasing molecular weights, in which polyester prepolymer containing an isocyanate group is subjected to a polyaddition reaction with amines in a reaction system where an organic solvent and an aqueous medium are mixed.

In the case of the aforementioned methods and toners obtained by such methods, hot offset resistance of the resulting toner improves, but low temperature fixing ability thereof is degraded, and glossiness of an image after fixing reduces. Therefore, these methods are not yet sufficient enough to solve the problems.

Furthermore, the toner production methods disclosed in PTL4 and PTL5 can be easily employed to a polycondensation reaction, which is a high temperature reaction, but cannot be employed to the aforementioned reaction system where the organic solvent and the aqueous medium are mixed, unless various conditions are optimized.

Although the crystalline polyester resin is introduced by the polymerization method in PTL6 and PTL7 for improving the low temperature fixing ability of the toner, the dispersion liquid having small particle diameters cannot be stably obtained. As a result, undesirable toner particle size distribution is provided, and moreover the crystalline polyester resin is extruded onto surfaced of toner particles, which causes filming. Therefore, these are not sufficient.

Accordingly, it is a current situation that it is desired to promptly provide a toner and a developer containing the toner, having excellent low temperature fixing ability and offset resistance, and capable of forming high quality images with excellent sharpness over a long period without causing filming of a crystalline polyester resin.

CITATION LIST

Patent Literature

PTL 1 Japanese Patent Application Laid-Open (JP-A) No. 11-133665

PTL 2 JP-A No. 2002-287400
PTL 3 JP-A No. 2002-351143
PTL 4 Japanese Patent (JP-B) No. 2579150
PTL 5 JP-A No. 2001-158819
PTL 6 JP-A No. 08-176310
PTL 7 JP-A No. 2005-15589
PTL 8 JP-B No. 4347174
PTL 9 JP-B No. 4023119

SUMMARY OF INVENTION

Technical Problem

The present invention aims to provide a toner having excellent low temperature fixing ability, and desirable offset resistance, and being capable of forming high quality images with excellent sharpness over a long period without causing filming of a crystalline polyester resin, as well as providing a developer containing the toner.

Solution to Problem

The means for solving the problem mentioned above are as follow:

<1> A toner, containing:

a binder resin;

a colorant;

a releasing agent; and a crystalline polyester resin, wherein the toner satisfies the following formulae (1) to (3):

$$40° \text{ C.} \leq X \leq 55° \text{ C.} \quad \text{Formula (1)}$$

$$85° \text{ C.} \leq Y \leq 92° \text{ C.} \quad \text{Formula (2)}$$

$$35° \text{ C.} \leq Y - X \leq 50° \text{ C.} \quad \text{Formula (3)}$$

where X is an onset temperature and Y is an endset temperature of an endothermic peak on a differential scanning calorimetry (DSC) curve of the toner as measured by a differential scanning calorimeter (DSC).

<2> The toner according to <1>, wherein the toner is obtained by the method containing:

dispersing, in an aqueous medium, an oil phase which contains an organic solvent, and at least the crystalline polyester resin and a non-crystalline polyester resin dissolved or dispersed in the organic solvent, to prepare an O/W dispersion liquid; and removing the organic solvent from the O/W dispersion liquid.

<3> The toner according to <2>, wherein the oil phase further contains a binder resin precursor.

<4> The toner according to <3>, wherein the toner is obtained by the method containing:

dispersing, in the aqueous medium containing a dispersant, the oil phase which contains the organic solvent, and at least the colorant, the releasing agent, the crystalline polyester resin, a compound containing an active hydrogen group, and the binder resin precursor having a site reactive to the compound containing an active hydrogen group, dissolved or dispersed in the organic solvent, to prepare an emulsified dispersion liquid;

allowing the binder resin precursor and the compound containing an active hydrogen group to react in the emulsified dispersion liquid; and removing the organic solvent from the emulsified dispersion liquid.

<5> The toner according to <1>, wherein the toner is obtained by the method containing:

melting and kneading a toner material containing at least the crystalline polyester resin, and a non-crystalline polyester resin to obtain a melt-kneaded product;

pulverizing the melt-kneaded product to obtain a pulverized product; and classifying the pulverized product.

<6> The toner according to <5>, wherein the method further comprising annealing at temperature that is an onset temperature ±5° C., where the onset temperature is calculated from a DSC curve of the crystalline polyester resin as measured by the differential scanning calorimeter with elevating temperature.

<7> The toner according to <1>, wherein the toner is obtained by the method containing:

dispersing the crystalline polyester resin, and a non-crystalline polyester resin, respectively in separate aqueous media to emulsify the crystalline polyester and the non-crystalline polyester as crystalline polyester resin particles, and non-crystalline polyester resin particles, respectively;

mixing the crystalline polyester resin particles, the non-crystalline polyester resin particles, a releasing agent dispersion liquid in which the releasing agent is dispersed, and a colorant dispersion liquid in which the colorant is dispersed, to prepare an aggregated particle dispersion liquid in which aggregated particles are dispersed; and heating the aggregated particle dispersion liquid to a temperature equal to or higher than a glass transition temperature of the resin contained in the aggregated particles to fuse and combine the aggregated particles to thereby form toner particles.

<8> The toner according to <7>, wherein the method further comprises annealing at an onset temperature ±5° C., where the onset temperature is calculated from a DSC curve of the crystalline polyester resin as measured by the differential scanning calorimeter with elevating temperature.

<9> The toner according to any one of <1> to <8>, wherein the crystalline polyester resin has a melting point of 60° C. to 80° C.

<10> The toner according to any one of <1> to <9>, wherein the toner satisfies the following relational expressions:

$$10 \text{ mgKOH/g} < A < 40 \text{ mgKOH/g}$$

$$0 \text{ mgKOH/g} < B < 20 \text{ mgKOH/g}$$

$$20 \text{ mgKOH/g} < A + B < 40 \text{ mgKOH/g}$$

where A represents an acid value of the crystalline polyester resin, and B represents a hydroxyl value of the crystalline polyester resin.

<11> The toner according to any one of <2> to <10>, wherein the toner satisfies the following relational expression:

$$-10 \text{ mgKOH/g} < A - C < 10 \text{ mgKOH/g}$$

where A represents an acid value of the crystalline polyester resin, and C represents an acid value of the non-crystalline polyester resin.

<12> The toner according to any one of <1> to <11>, wherein the crystalline polyester resin is prepared from a C4-C12 saturated dicarboxylic acid, and a C4-C12 saturated diol.

<13> The toner according to any one of <1> to <12>, wherein a proportion of the crystalline polyester resin having a number average molecular weight of 500 or smaller is 0% to 2% of the crystalline polyester resin, and a proportion of the crystalline polyester resin having a number average molecular weight of 1,000 or smaller is 0% to 4% of the crystalline polyester resin.

<14> The toner according to any one of <1> to <13>, wherein the releasing agent has a melting point of 60° C. to 75° C.

<15> The toner according to any one of <1> to <14>, wherein the releasing agent is at least one selected from the group consisting of microcrystalline wax, paraffin wax, and ester wax.

<16> A developer, containing:

the toner as defined in any one of <1> to <15>.

Advantageous Effects of Invention

The present invention solves the various problems in the art and achieves the object mentioned above, and provides a toner having excellent low temperature fixing ability, and desirable offset resistance, and being capable of forming high quality images with excellent sharpness over a long period without causing filming of a crystalline polyester resin, as well as providing a developer containing the toner.

BRIEF DESCRIPTION OF DRAWING

FIG. 1 is a drawing indicating an onset temperature X and an endset temperature Y of an endothermic peak on a differential scanning calorimetry curve of the toner as measured by a differential scanning calorimeter (DSC).

DESCRIPTION OF EMBODIMENTS (Toner)

The toner of the present invention contains at least a binder resin, a colorant, a releasing agent, and a crystalline polyester resin, and may further contain other components, if necessary.

In the present invention, an onset temperature X and an endset temperature Y of a differential scanning calorimetry (DSC) curve of the toner as measured by a differential scanning calorimeter (DSC) satisfy the following formulae (1) to (3):

$$40° \text{ C.} \leq X \leq 55° \text{ C.} \quad \text{Formula (1)}$$

$$85° \text{ C.} \leq Y \leq 92° \text{ C.} \quad \text{Formula (2)}$$

$$35° \text{ C.} \leq Y - X \leq 50° \text{ C.} \quad \text{Formula (3)}$$

Note that, the onset temperature X of the endothermic peak of the toner represents an endothermic onset temperature of the crystalline polyester resin in the toner, and the endset temperature Y of the endothermic peak of the toner represents an endothermic endset temperature of the releasing agent (e.g. wax) in the toner.

The onset temperature X of the endothermic peak of the toner is 40° C. to 55° C. When the onset temperature X is lower than 40° C., the toner may have poor heat resistance storage stability, and moreover formations of abnormal images, such as unintentional white lines formed in solid images, may be seen after storing the toner at high temperature. When the onset temperature X is higher than 55° C., the low temperature fixing ability of the toner may be impaired.

The endset temperature Y of the endothermic peak of the toner is 85° C. to 92° C. When the endset temperature Y is lower than 85° C., the resulting toner may cause filming, and formations of abnormal images, such as unintentional white lines formed in solid images, after storing the toner at high temperature toner, and may have poor hot offset resistance. When the endset temperature Y is higher than 92° C., the low temperature fixing ability of the toner may be impaired.

The onset temperature can be adjusted by appropriately adjusting the melting onset temperature of the crystalline polyester, and the endset temperature can be adjusted by appropriately adjusting the melting endset temperature of the releasing agent (e.g. wax).

In order to obtain the toner having excellent low temperature fixing ability, and desirable offset resistance, without causing filming of the crystalline polyester resin, and being capable of forming high quality images with excellent sharpness over a long period, it is preferred that the melting point of the releasing agent (e.g. wax) is higher than the melting point of the crystalline polyester.

The onset temperature X and endset temperature Y of the endothermic peak satisfies the formula: 35° C.≤Y−X≤50° C., preferably the formula: 35° C.≤Y−X≤45° C.

When the difference between Y and X, i.e. Y−X, is less than 35° C., the heat resistance storage stability of the resulting toner may be impaired. When the difference is more than 50° C., the lowest fixing temperature of the resulting toner may not be desirable.

Note that, the onset temperature X and endset temperature Y of the endothermic peak of the toner can be measured, for example, by DSC.

The onset temperature X and endset temperature Y can be measured by the following method using a DSC system (differential scanning calorimeter, Q-200, manufactured by TA INSTRUMENTS JAPAN INC.). At first, about 5.0 mg of the toner is weight and added to an aluminum sample container. The sample container is placed on a holder unit, and set in an electric furnace. Next, in a nitrogen atmosphere (flow rate: 50 mL/min), the sample is heated from −20° C. to 150° C. at a temperature increasing rate of 1° C./min, temperature modulation cycle of 60 seconds, and temperature modulation amplitude of 0.159° C. Thereafter, the sample is cooled from 150° C. to 0° C. at a temperature decreasing rate of 10° C./min. In this process, a DSC curve of the sample is measured with a differential scanning calorimeter (Q-200, TA INSTRUMENTS JAPAN INC.) (see FIG. 1). From the obtained the DSC curve, an endothermic peak of the DSC curve during the initial temperature elevation was selected, and a temperature width of the curve at the position where the height thereof is ⅓ of the height from the base line to the top of the endothermic peak.

The "peak temperature" means that a peak top temperature of an endothermic peak (the direction where the value of heat flow (W/g) is minus indicates endotherm).

The "onset temperature X" means a temperature at the intersection between the base line and a tangent line drawn at the point at which a peak curve of the endothermic peak derived from the endothermic peak gives the maximum derivative (see FIG. 1).

The "endset temperature Y" means, comparative with the onset temperature which corresponds to endothermic onset, a temperature at the intersection between the base line and the point on the peak curve indicating the endothermic endset (see FIG. 1).

The crystalline polyester resin for use in the present invention preferably has a melting point of 60° C. to 80° C., more preferably 65° C. to 75° C.

When the melting point of the crystalline polyester resin is lower than 60° C., the heat resistance storage stability of the resulting toner may be poor. When the melting point thereof is higher than 80° C., the low temperature fixing ability of the resulting toner may be poor.

Moreover, the releasing agent (e.g. wax) preferably has a melting point of 60° C. to 75° C.

When the melting point of the releasing agent (e.g. wax) is lower than 60° C., the heat resistance storage stability of the resulting toner may be poor. When the melting point thereof is higher than 75° C., the low temperature fixing ability of the resulting toner may be poor.

Note that, the melting points of the crystalline polyester resin and the releasing agent (e.g. wax) can be obtained, for example, by measuring the maximum endothermic peak using a differential scanning calorimeter TG-DSC System TAS-100 (manufactured by Rigaku Corporation).

By setting the melting point of the crystalline polyester resin and the melting point of the releasing agent (e.g. wax) in the ranges described above, excellent low temperature fixing ability of the toner can be attained. In the case where the melting point of the releasing agent (e.g. wax) is high, the hot offset resistance of the resulting toner may be desirable, but the low temperature fixing ability is poor. In the case where the melting point thereof is low, excellent low temperature fixing ability may be attained, but the heat resistance storage stability is poor. Taking this under consideration, by melting the releasing agent (e.g. wax) in the temperature range at which the crystalline polyester resin melts, the resulting toner can attain excellent low temperature fixing ability, and moreover has a desirable heat resistance storage stability without being impaired. Namely, in the case where a DSC measurement is performed on the toner satisfying these conditions, an endothermic peak of the crystalline polyester resin is observed, and the endotherm of the releasing agent (e.g. wax) is observed with overlapping the endothermic peak of the crystalline polyester resin. To achieve both the desirable low temperature fixing ability and heat resistance storage stability, therefore, it is important that the onset temperature X and endset temperature Y of the endothermic peak on the DSC curve of the toner measured by a differential scanning calorimeter (DSC) satisfy the following formulae (1) to (3):

$$40° \text{ C.} \leq X \leq 55° \text{ C.} \quad \text{Formula (1)}$$

$$85° \text{ C.} \leq Y \leq 92° \text{ C.} \quad \text{Formula (2)}$$

$$35° \text{ C.} \leq Y - X \leq 50° \text{ C.} \quad \text{Formula (3)}$$

In order for the conventionally known pulverized toner to satisfy 35° C.≤Y−X≤50° C., it is preferred that annealing be performed.

The annealing is preferably performed at an onset temperature ±5° C., where the onset temperature is calculated from the DSC curve of the crystalline polyester resin as measured by a differential scanning calorimeter with elevating temperature.

The pulverized toner is obtained by melting and kneading a toner material containing at least the crystalline polyester resin and a non-crystalline polyester resin. Upon melting and kneading of the toner material, the crystalline polyester resin and the non-crystalline polyester resin become a compatible state. If the DSC measurement is performed on such the toner, an endothermic peak is not clearly shown, and the endothermic peak temperature becomes lower than 50° C. The toner with such the endothermic properties has excellent low temperature fixing ability, but the heat resistance storage stability thereof is very poor. By performing an annealing, a phase separation between the crystalline polyester resin and the non-crystalline polyester resin is progressed. In other words, the compatible state between the crystalline polyester resin and the non-crystalline polyester resin disappears. In the case where the phase separation thereof is progressed, in the DSC measurement, a clear endothermic peak appears at 50° C. to 100° C.

As the toner, a chemical toner can be also used. On the toner obtained by the emulsification aggregation method, which is the chemical toner, however, it is preferred that annealing be performed.

In the emulsification aggregation method, the toner can be obtained by emulsifying or dispersing the toner material in water, aggregating and heating the resulting emulsified or dispersed elements. Since the heating is performed at the temperature which is around the melting point of the binder resin used, the crystalline polyester resin and the non-crystalline polyester resin become a compatible state, and therefore, similarly to the case of the pulverized toner, both desirable heat resistance storage stability and low temperature fixing ability cannot be attained at the same time. For this reason, it is desirable to perform annealing.

The annealing is preferably performed at an onset temperature ±5° C., where the onset temperature is calculated from the DSC curve of the crystalline polyester resin obtained during the temperature elevation in the DSC measurement with a differential scanning calorimeter.

In the case where the crystalline polyester resin and the non-crystalline polyester resin is used for obtaining a toner in the method in which the toner material is dissolved in an organic solvent, and the resulting solution is emulsified or dispersed in water, the crystalline polyester resin is preferably dispersed in the organic solvent at low temperature. Generally, the crystalline polyester resin dispersed in the organic solvent gives high viscosity. This is not very problematic at a laboratory experimental scale, but causes such a problem at a mass-production scale that stirring or fluid feeding cannot be carried out. To counter this problem, the non-crystalline polyester resin can be added to reduce the viscosity. In the case where the crystalline polyester resin and the non-crystalline polyester resin are mixed and then dispersed in the organic solvent, they become a compatible state, if the temperature is high. In this case, similar to the case of the pulverized toner, the resulting toner cannot achieve both the desirable heat resistance storage stability and low temperature fixing ability. Therefore, when the crystalline polyester resin and the non-crystalline polyester resin are mixed and dispersed in the organic solvent, it is desirable to sufficiently cool the system during the dispersing. The cooling temperature during the dispersing is lower than the onset temperature in the DSC measurement of the crystalline polyester resin by 10° C. or more. Similarly, when the organic solvent used is removed, the temperature is lower than the onset temperature in the DSC measurement of the crystalline polyester resin by 10° C. or more.

The organic solvent is preferably an organic solvent, which can dissolve the crystalline polyester resin completely at high temperature to form a uniform solvent, and can cause a phase separation with the crystalline polyester resin once cooled to form an opaque heterogeneous solution.

Examples of the organic solvent include toluene, ethyl acetate, butyl acetate, methyl ethyl ketone, and methyl isobutyl ketone. These may be used independently, or in combination.

Since the crystalline polyester resin in the toner has high crystallinity, the toner has such thermofusion properties that the toner decreases its viscosity largely at around the fixing onset temperature. Specifically, the toner has excellent heat resistance stability doe to the crystallinity of the crystalline polyester just under the melting onset temperature, and decreases its viscosity largely (exhibiting sharp melting properties) at the melting onset temperature to be fixed. Therefore, the toner having both excellent heat resistance storage stability and low temperature fixing ability can be obtained. Moreover, such the toner also has excellent fusing latitude (i.e. a range between the lowest fixing temperature and the hot offset temperature).

<Crystalline Polyester Resin>

The crystalline polyester resin can be synthesized from an alcohol component, such as a C2-C12 saturated diol compound (e.g. 1,4-butanediol, 1,6-hexanediol, 1,8-octanediol, 1,10-decanediol, 1,12-dodecanediol, and derivatives thereof), and an acid component including at least a C2-C12 dicarboxylic acid having a double bond (C═C), or a C2-C12 saturated carboxylic acid (e.g. fumaric acid, 1,4-butanedioic acid, 1,6-hexanedioic acid, 1,8-octanedioic acid, 1,10-decanedioic acid, 1,12-dodecanedioic acid, and derivatives thereof). Among them, the crystalline polyester resin is preferably consisted of the saturated C4-12 diol component selected from 1,4-butanediol, 1,6-hexanediol, 1,8-octanediol, 1,10-decanediol, and 1,12-dodecanediol, and the saturated C4-12 dicarboxylic acid component selected from 1,4-butanedioic acid, 1,6-hexanedioic acid, 1,8-octanedioic acid, 1,10-decanedioic acid, and 1,12-dodecanedioic acid is particularly preferable because the resulting crystalline polyester resin has high crystallinity and shows drastic viscosity change at around the melting point thereof.

As a method for controlling the crystallinity and softening point of the crystalline polyester resin, there is a method in which a trihydric or higher polyhydric alcohol such as glycerin is added to the alcohol component and tri or higher valent polycarboxylic acid such as trimellitic anhydride is added to the acid component to proceed to a condensation polymerization to yield a non-linear polyester, and such the non-linear polyester is designed and used during the synthesis of polyester.

The molecular structure of the crystalline polyester resin can be confirmed by X-ray diffraction, GC/MS, LC/MS, and IR measurements, as well as NMR of a solution or solid thereof. A simple method is that the molecular structure thereof is confirmed by an infrared absorption spectrum thereof having an absorption originated from δCH (out-of-plane deformation vibration) of olefine at 965±10 $cm^{-1}$ or 990±10 $cm^{-1}$.

Regarding the molecular weight of the crystalline polyester resin, the crystalline polyester resin with a sharp molecular weight distribution and low molecular weights has excellent low temperature fixing ability, and the crystalline polyester resin having a large amount of low molecular weight crystalline polyester molecules has poor heat resistance storage stability. Therefore, the weight average molecular weight thereof is preferably 5,000 to 20,000 in the molecular weight distribution as measured by GPC of the o-dichlorobenzene soluble component.

In the case where a proportion of the crystalline polyester resin having the number average molecular weight of 500 or smaller is 0% to 2%, and a proportion of the crystalline polyester resin having the number average molecular weight of 1,000 or smaller is 0% to 4% relative to the entire crystalline polyester resin, both low temperature fixing ability, and heat resistance storage stability can be achieved at the same time.

Given that the acid value of the crystalline polyester resin is defined as A and the hydroxyl value of the crystalline polyester resin is defined as B, the crystalline polyester resin preferably satisfies the following relational expressions:

$$10\ \text{mgKOH/g} < A < 40\ \text{mgKOH/g}$$

$$0\ \text{mgKOH/g} < B < 20\ \text{mgKOH/g}$$

$$20\ \text{mgKOH/g} < A+B < 40\ \text{mgKOH/g}$$

When the acid value A of the crystalline polyester resin is 10 mgKOH/g or lower, the resulting toner has poor compatibility to paper, which is a recording member, and this may result in poor heat resistance storage stability. When the acid value A of the crystalline polyester resin is 40 mgKOH/g or higher, or the hydroxyl value B of the crystalline polyester resin is 20 mgKOH/g or lower, the resulting toner may have poor charging ability in the high temperature high humidity environment.

When the sum of the acid value and hydroxyl value thereof is 20 mgKOH/g or lower, the crystalline polyester has low compatibility to the non-crystalline polyester resin, this may result in insufficient low temperature fixing ability of the toner. When the sum of the acid value and hydroxyl value thereof is 40 mgKOH/g or higher, the compatibility between the crystalline polyester resin and the non-crystalline polyester resin is excessively high, the resulting toner may have poor heat resistance storage stability.

Note that, the acid value and the hydroxyl value can be measured, for example, in accordance with the method specified in JIS K0070.

The solubility of the crystalline polyester resin to the organic solvent of 70° C. is preferably 10 parts by mass or more. When the solubility thereof is less than 10 parts by mass, the compatibility between the organic solvent and the crystalline polyester resin is poor, and therefore it is difficult to disperse the crystalline polyester resin to the size of submicron order in the organic solvent. As a result, the crystalline polyester resin is ununiformly present in the toner, this may result in poor charging ability of the toner, or poor image quality of images formed with the resulting toner after long period of use.

The solubility of the crystalline polyester resin to the organic solvent of 20° C. is preferably less than 3.0 parts by mass. When the solubility thereof is 3.0 parts by mass or more, the crystalline polyester resin dissolved in the organic solvent tends to be compatible to the non-crystalline polyester resin even before heating, this may result in poor resistance storage stability of the resulting toner, contaminations of the developing unit, and deterioration in qualities of images formed with the resulting toner.

—Dissolution and Recrystallization Method of Crystalline Polyester Resin in Organic Solvent—

A method of dissolving and recrystallizing the crystalline polyester resin in the organic solvent is as follows.

A crystalline polyester resin (10 g) and an organic solvent (90 g) are stirred for 1 hour at 70° C.

The solution obtained after the stirring is cooled over 12 hours at 20° C. to thereby recrystallize the crystalline polyester.

The dispersion liquid, in which the recrystallized crystalline polyester resin is dispersed in the organic solvent, is introduced into KIRIYAMA funnel (manufactured by Kiriyama Glass Co., Ltd.) where filter paper No. 4 (manufactured by Kiriyama Glass Co., Ltd.) for KIRIYAMA funnel is set, and is subjected to suction filtration by an aspirator, to separate into the organic solvent and the crystalline polyester resin. The crystalline polyester resin obtained by the separation is dried for 48 hours at 35° C., to thereby yield the recrystallized crystalline polyester.

—Evaluation of Solubility of Crystalline Polyester Resin to Organic Solvent—

The solubility of the crystalline polyester resin to the organic solvent is determined by the following method.

A crystalline polyester resin (20 g) and an organic solvent (80 g) are stirred for 1 hour at the predetermined temperature.

The solution obtained from the stirring is introduced into KIRIYAMA funnel (manufactured by Kiriyama Glass Co., Ltd.) where filter paper No. 4 (manufactured by Kiriyama Glass Co., Ltd.) for KIRIYAMA funnel is set, and is subjected to suction filtration by an aspirator at the predetermined temperature, to separate into the organic solvent and the crystalline polyester resin. The organic solvent obtained after the separation is heated for 1 hour at the temperature that is the boiling point of the organic solvent+50° C. to evaporate the organic solvent. Based on the change in the weight before and after the heating, the amount of the crystalline polyester resin dissolved in the organic solvent is calculated.

The toner of the present invention is obtained by the method including: dispersing, in an aqueous medium, an oil phase which contains an organic solvent, and at least a crystalline polyester resin and a non-crystalline polyester resin dissolved or dispersed in the organic solvent to prepare an O/W dispersion liquid; and removing the organic solvent from the O/W dispersion liquid.

The oil phase preferably further contains a binder resin precursor.

Moreover, the toner of the present invention is preferably a toner obtained by the method containing: dispersing, in the aqueous medium containing a dispersant, the oil phase which contains the organic solvent, and at least the colorant, the releasing agent, the crystalline polyester resin, a compound containing an active hydrogen group, and the binder resin precursor having a site reactive to the compound containing an active hydrogen group, dissolved or dispersed in the organic solvent to prepare an emulsified dispersion liquid; allowing the binder resin precursor and the compound containing an active hydrogen group to react in the emulsified dispersion liquid; and removing the organic solvent from the emulsified dispersion liquid.

<Binder Resin>

The binder resin is appropriately selected depending on the intended purpose without any restriction, but it is preferred that the binder resin contain a non-crystalline polyester resin, a modified polyester resin, unmodified polyester resin, and other binder resin(s).

<<Modified Polyester Resin and Binder Resin Precursor>>

As the binder resin precursor, polyester prepolymer modified with isocyanate or epoxy can be used. By reacting the polyester prepolymer with the compound containing an active hydrogen group to perform a crosslink and/or elongation reaction, a modified polyester resin (i.e., a modified polyester resin containing a urethane bond and/or urea bond) is obtained. By using the modified polyester resin, the resulting toner can have an appropriate degree of the crosslink structure, which enhances improvement of fusing latitude (i.e. a range between the lowest fixing temperature and the hot offset temperature).

The modified polyester resin can be produced by a one-shot method, or the like. As one example, a production method of a urea-modified polyester resin will be explained hereinafter.

At first, polyol and polycarboxylic acid are heated to 150° C. to 280° C. in the presence of a catalyst such as tetrabutoxy titanate, and dibutyl tin oxide, optionally removing generated water under the reduced pressure, to thereby yield a polyester resin containing a hydroxyl group. Next, the polyester resin containing a hydroxyl group and polyisocyanate are allowed to react at 40° C. to 140° C., to yield polyester prepolymer containing an isocyanate group. Then, the polyester prepolymer containing an isocyanate group and amines are allowed to react at 0° C. to 140° C. to yield a urea-modified polyester resin.

A number average molecular weight (Mn) of the urea-modified polyester resin is preferably 1,000 to 10,000, more preferably 1,500 to 6,000.

Note that, a solvent is optionally used for the reaction between the polyester resin containing a hydroxyl group and the polyisocyanate, and the reaction between the polyester prepolymer containing an isocyanate group and the amines.

The solvent is appropriately selected depending on the intended purpose without any restriction. Examples thereof include inert compounds to the isocyanate group, such as aromatic solvents (e.g. toluene, and xylene), ketones (e.g. acetone, methyl ethyl ketone, and methyl isobutyl ketone), esters (e.g. ethyl acetate), amides (e.g. dimethylformamide, and dimethylacetoamide), and ethers (e.g. tetrahydrofuran).

—Polyester Prepolymer—

The polyester prepolymer can be easily synthesized by reacting, with a polyester resin (base reactant), an isocyanating agent, an epoxidizing agent, etc. which are conventionally known. Examples of the isocyanating agent include: aliphatic polyisocyanate (e.g., tetramethylene diisocyanate, hexamethylene diisocyanate, and 2,6-diisocyanate methyl caproate); alicyclic polyisocyanate (e.g. isophorone diisocyanate, and cyclohexylmehane diisocyanate); aromatic diisocyanate (e.g. tolylene diisocyanate, and diphenylmethane diisocyanate); aromatic aliphatic diisocyanate (e.g. $\alpha,\alpha,\alpha',\alpha'$-tetramethyl xylylene diisocyanate); isocyanirates; the polyisocyanates mentioned above, each of which is blocked with a phenol derivative, oxime, caprolactam, or the like; and a combination of any of those listed. Moreover, a representative example of the epoxidizing agent is epichlorohydrin, etc.

A ratio of the isocyanating agent is determined as an equivalent ratio [NCO]/[OH] of the isocyanate group [NCO] to the hydroxyl group [OH] of the polyester as a base, and the equivalent ratio [NCO]/[OH] is preferably 5/1 to 1/1, more preferably 4/1 to 1.2/1, and even more preferably 2.5/1 to 1.5/1. When the equivalent ratio [NCO]/[OH] is larger than 5/1, the resulting toner may have low temperature fixing ability.

When the molar ratio of [NCO] is smaller than 1, the urea content of the polyester prepolymer is low, and therefore the resulting toner may have poor hot offset resistance.

An amount of the isocyanating agent in the polyester prepolymer is preferably 0.5% by mass to 40% by mass, more preferably 1% by mass to 30% by mass, and even more preferably 2% by mass to 20% by mass. The amount of the isocyanating agent is smaller than 0.5% by mass, the hot-offset resistance of the resulting toner is poor, and it may be disadvantageous in attaining both the heat resistance storage stability and the low temperature fixing ability. When the amount thereof is greater than 40% by mass, the low temperature fixing ability of the resulting toner may be poor.

Moreover, the number of the isocyanate groups per molecule of the polyester prepolymer is generally 1 or more, preferably 1.5 to 3 on average, and more preferably 1.8 to 2.5 on average. When the number of the isocyanate groups per molecule is less than 1, the molecular weight of the urea-modified polyester resin after the elongation reaction is small, this may result in poor hot-offset resistance of the resulting toner.

The weight average molecular weight of the polyester prepolymer is preferably $1\times10^4$ to $3\times10^5$.

—Compound Containing Active Hydrogen Group—

The compound containing an active hydrogen group is a compound capable of undergoing an elongation reaction or crosslink reaction with the binder resin precursor (prepolymer) having a functional group reactive to the active hydrogen group of the compound containing an active hydrogen group, and representative examples of the compound include amines.

Examples of the amines include a diamine compound, a tri or higher polyamine compound, an amino alcohol compound, an aminomercaptan compound, an amino acid compound, and the preceding compounds whose amino group is blocked.

Examples of the diamine compound include: aromatic diamine (e.g. phenylene diamine, diethyl toluene diamine, and 4,4'-diaminodiphenyl methane); alicyclic diamine (e.g. 4,4'-diamino-3,3'-dimethyldichlorohexyl methane, diamine cyclohexane, and isophorone diamine); and aliphatic diamine (e.g. ethylene diamine, tetramethylene diamine, and hexamethylene diamine). Examples of the tri or higher polyamine compound include diethylene triamine, and triethylene tetramine. Examples of the amino alcohol compound include ethanol amine, and hydroxyethyl aniline. Examples of the aminomercaptan compound include aminoethylmercaptan, and aminopropylmercaptan. Examples of the amino acid compound include amino propionic acid, and amino caproic acid. Examples of the compound whose amino group is blocked include an oxazolidine compound and ketimine compound derived from the amines and ketones (e.g., acetone, methyl ethyl ketone and methyl isobutyl ketone). Among these amines, the diamine compound alone, or a mixture of the diamine compound and a small amount of the polyamine compound is preferable.

<<Non-Crystalline Polyester Resin>>

The non-crystalline polyester resin obtained by using a polyhydric alcohol component, and a polycarboxylic acid component such as polycarboxylic acid, polycarboxylic anhydride, and polycarboxylic acid ester.

Note that, in the present specification, the term "non-crystalline polyester resin" indicates one obtained by using a polyhydric alcohol component, and a polycarboxylic acid component such as polycarboxylic acid, polycarboxylic anhydride, and polycarboxylic acid ester, as mentioned above, and a modified polyester resin, for example, the below-mentioned prepolymer, and modified polyester resin obtained by the crosslink and/or elongation reaction of the prepolymer (i.e. a modified polyester resin containing a urethane bond and/or urea bond) are not regarded as the non-crystalline polyester resin, and are defined as a modified polyester resin in the present specification.

The polyhydric alcohol component is appropriately selected depending on the intended purpose without any restriction. Examples of the polyhydric alcohol component include: alkylene(C2-C3)oxide adduct (average added mole number of 1 to 10) of bisphenol A such as polyoxypropylene (2,2)-2,2-bis(4-hydroxyphenyl)propane, and polyoxyethylene(2,2)-2,2-bis(4-hydroxyphenyl)propane; and others such as ethylene glycol, propylene glycol, neopenthyl glycol, glycerin, pentaerythritol, trimethylolpropane, hydrogenated bisphenol A, sorbitol, or alkylene(C2-C3)oxide adduct (average added mole number of 1 to 10) of the preceeding compounds. These may be used independently, or in combination.

The polyhydric carboxylic acid component is appropriately selected depending on the intended purpose without any restriction. Examples thereof include: dicarboxylic acid such as adipic acid, phthalic acid, isophthalic acid, terephthalic acid, fumaric acid, and maleic acid; C1-C20 alkyl group-substituted or C2-C20 alkenyl group-substituted succinic acid such as dodecenyl succinic acid, and octyl succinic acid; others such as trimellitic acid, and pyromellitic acid; and anhydrides or alkyl(C1-C8) esters of the preceding acids. These may be used independently, or in combination.

The non-crystalline polyester resin, the prepolymer, and the resin obtained by the crosslink and/or elongation reaction of the prepolymer (i.e., the modified polyester resin containing a urethane bond and/or urea bond) are appropriately selected depending on the intended purpose without any restriction, but these are preferably compatible to each other at least at part thereof. The compatibility of these polymers contributes to the improvement of the low temperature fixing ability and hot offset resistance of the resulting toner. To make them compatible to each other, the polyhydric alcohol component and polycarboxylic acid component constituting the non-crystalline polyester resin and the polyhydric alcohol component and polycarboxylic acid component constituting the prepolymer are preferably identical or similar.

Given that the acid value of the crystalline polyester resin is defined as A and the acid value of the non-crystalline polyester resin is defined as C, the crystalline polyester resin and the non-crystalline polyester resin preferably satisfy the relational expression:

$$-10\ \text{mgKOH/g} < A - C < 10\ \text{mgKOH/g},$$

When the value deducted the acid value of the non-crystalline polyester from that of the crystalline polyester resin is 10 or more, the crystalline polyester resin and the non-crystalline polyester resin may have poor compatibility to each other, this may result in poor low temperature fixing ability of the resulting toner. In addition, the crystalline polyester resin tends to be extruded onto a surface of the toner particle, this may result in the contamination of the developing unit, or filming.

The binder resin component contained in the oil phase may contain the crystalline polyester resin, the non-crystalline polyester resin, the binder resin precursor, and the unmodified polyester resin in combination, and, in addition to these, may further contain other binder resin substances. The binder resin component preferably contains a polyester resin, more preferably contains the polyester resin in an amount of 50% by mass or more. When the amount of the polyester resin is less than 50% by mass, the resulting toner may have poor low temperature fixing ability. It is particularly preferred that the entire binder resin component be formed of the polyester resin (including the crystalline polyester resin, non-crystalline polyester resin, modified polyester resin etc.).

Other binder resin components than the polyester resin are appropriately selected depending on the intended purpose without any restriction, and examples thereof include a styrene-acryl resin, a polyol resin, a vinyl resin, a polyurethane resin, an epoxy resin, a polyamide resin, a polyimide resin, a silicon-based resin, a phenol resin, a melamine resin, a urea resin, an aniline resin, an iomer resin, and a polycarbonate resin. These may be used independently, or in combination.

—Colorant—

The colorant is appropriately selected from dyes and pigments known in the art without any restriction, and examples thereof include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinone blue, fast violet B, methylviolet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, lithopone, and a mixture thereof. These may be used independently, or in combination.

An amount of the colorant is preferably 1% by mass to 15% by mass, more preferably 3% by mass to 10% by mass, relative to the toner.

The colorant may be used in the form of a master batch in which the colorant forms a composite with a resin. The resin used for production of the master batch or kneaded together with the master batch includes the modified polyester resin, and non-modified polyester resin mentioned above. Other examples of the resin include: styrene polymers and substituted products thereof (e.g., polystyrenes, poly-p-chlorostyrenes and polyvinyltoluenes); styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers); polymethyl methacrylates; polybutyl methacrylates; polyvinyl chlorides; polyvinyl acetates; polyethylenes; polypropylenes; epoxy resins; epoxy polyol resins; polyurethane resins; polyamide resins; polyvinyl butyrals; polyacrylic acid resins; rosin; modified rosin; terpene resins; aliphatic or alicyclic hydrocarbon resins; aromatic petroleum resins; chlorinated paraffin; and paraffin wax. These may be used independently, or in combination.

The master batch can be prepared by mixing or kneading a colorant with the resin for use in the master batch through application of high shearing force. Preferably, an organic solvent may be used for improving the interactions between the colorant and the resin. Further, a so-called flashing method is preferably used, since a wet cake of the colorant can be directly used, i.e., no drying is required. Here, the flashing method is a method in which an aqueous paste containing a colorant is mixed or kneaded with a resin and an organic solvent, and then the colorant is transferred to the resin to remove the water and the organic solvent. In this mixing or kneading, for example, a high-shearing disperser (e.g., a three-roll mill) is preferably used.

—Releasing Agent—

The releasing agent is appropriately selected depending on the intended purpose without any restriction, but it is preferably wax having a melting point of 60° C. to 75° C. because such the wax has sufficiently low viscosity with application of heat during the fixing process, and is a material that is not compatible to a surface of a fixing member, or is not easily swollen.

The wax is appropriately selected depending on the intended purpose without any restriction, and examples thereof include: paraffin (e.g. paraffin wax, and sasol wax); synthetic esters (e.g. trimethylolpropane tribehenate, pentaerythritol tetrabehenate, pentaerythritol diacetate dibehenate, glycerin tribehenate, 1,18-octadecanediol distearate, tristearyl trimellitate, distearyl maleate, and octadecyl stearate); polyolefins (e.g. polyethylene wax, and polypropylene wax); natural vegetable wax (e.g. carnauba wax, rice wax, and candelilla wax); natural mineral wax (e.g. montan wax, ozokelite, and ceresin); and fatty acid amide-based synthetic wax (e.g. stearic acid amide). These may be used independently, or in combination.

Among them, any of the microcrystalline wax, paraffin wax, and ester wax is particularly preferable.

An amount of the releasing agent in the toner is appropriately selected depending on the intended purpose without any restriction, but it is preferably 40% by mass or less, more preferably 3% by mass to 30% by mass. When the amount thereof is more than 40% by mass, flowing ability of the resulting toner may be poor.

—Charge Controlling Agent—

The charge controlling agent is appropriately selected depending on the intended purpose without any restriction. Examples of the charge controlling agent include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine-based active agents, metal salts of salicylic acid, and metal salts of salicylic acid derivatives.

Specific examples thereof include: BONTRON 03 (nigrosine dye), BONTRON P-51 (quaternary ammonium salt), BONTRON S-34 (metal azo-containing dye), E-82 (oxynaphthoic acid-based metal complex), E-84 (salicylic acid-based metal complex) and E-89 (phenol condensate), all manufactured by ORIENT CHEMICAL INDUSTRIES CO., LTD; TP-302 and TP-415 (quaternary ammonium salt molybdenum complexes) both manufactured by Hodogaya Chemical Co., Ltd.; COPY CHARGE PSY VP 2038 (quaternary ammonium salt), COPY BLUE PR (triphenylmethane derivative), COPY CHARGE NEG VP2036 and COPY CHARGE NX VP434 (quaternary ammonium salts), all manufactured by Hoechst AG; LRA-901 and LR-147 (boron complexes), both manufactured by Japan Carlit Co., Ltd.; copper phthalocyanine; perylene; quinacridone; azo pigments; and polymeric compounds having, as a functional group, a sulfonic acid group, carboxyl group, quaternary ammonium salt, etc.

An amount of the charge controlling agent for use is determined depending on the binder resin for use, presence of optionally used additives, and the production method of the toner including the dispersing method, and thus cannot be determined unconditionally. It is, however, preferably 0.1 parts by mass to 10 parts by mass, more preferably 0.2 parts by mass to 5 parts by mass relative to 100 parts by mass of the binder resin. When the amount of the charge controlling agent is greater than 10 parts by mass, the electrostatic propensity of the resulting toner is excessively large, which reduces the effect of charge controlling agent. As a result, the electrostatic suction force toward the developing roller may increase, which may cause poor flowing ability of the developer, and low image density. The charge controlling agent may be added by dissolving and dispersing after fusing and kneading together with the master batch and the resin, or added by dissolving or dispersing directly in the organic solvent, or added by fixing on a surface of each toner particle after the preparation of the toner particles.

—External Additive—

The toner of the present invention may contain an external additive to aid flowing ability, developing ability, and electrostatic propensity of the toner.

As the external additive, inorganic particles are preferably used.

The primary particle diameter of the inorganic particles is preferably 5 nm to 2 μm, more preferably 5 nm to 500 nm. Moreover, the specific surface area of the inorganic particles as determined by the BET method is preferably 20 $m^2/g$ to 500 $m^2/g$.

An amount of the inorganic particles is preferably 0.01% by mass to 5% by mass, more preferably 0.01% by mass to 2.0% by mass, relative to the toner.

The inorganic particles are appropriately selected depending on the intended purpose without any restriction. Examples of the inorganic particles include silica, alumina, titanium oxide, barium titanate, magnesium titanate, calcium titanate, strontium titanate, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride.

Other examples of the external additive include polymer particles, such as particles produced by soap-free emulsification polymerization, suspension polymerization, or dispersion polymerization (e.g. polystyrene particles, (meth) acrylatic acid ester copolymer particles); polymer particles produced by polymerization condensation such as silicone particles, benzoguanamine particles, and nylon particles; and polymer particles of thermoset resins.

The flow improving agent is an agent capable of performing a surface treatment on the toner particles to improve hydrophobic properties of the toner so that the degradations of the toner in the flow properties or charging characteristics are prevented in the high humidity environment. Examples of the flow improving agent include a slane coupling agent, a sililating agent, a fluoroalkyl group-containing silane coupling agent, an organic titanate-based coupling agent, an aluminum-based coupling agent, silicone oil, and modified silicone oil.

The cleaning improving agent is added to the toner for removing the developer remaining on a photoconductor or a primary transfer member. Examples thereof include: metal salts of fatty acid (e.g. stearic acid), such as zinc stearate, and calcium stearate; polymer particles produced by soap-free emulsification polymerization, such as polymethyl methacrylate particles, and polystyrene particles. The polymer particles preferably have a relatively narrow particle size distribution, particularly preferably the volume average particle diameter (Dv) of 0.01 μm to 1 μm.

The magnetic material is appropriately selected from the conventional materials known in the art without any restriction. Examples thereof include iron powder, magnetite powder, and ferrite powder. Among them, a white magnetic material is preferable in terms of the color toner.

—Toner Volume Average Particle Diameter (Dv) and Number Average Particle Diameter (Dn)—

The volume average particle diameter (Dv) and number average particle diameter (Dn) of the toner of the present invention can be determined by measuring the toner by means of a particle analyzer (Coulter Multisizer III, manufactured by Beckman Coulter, Inc.) with the aperture diameter of 100 μm, and analyzing using an analysis software (Beckman Coulter Multisizer 3 Version 3.51).

Specifically, a 100 mL glass beaker is charged with 0.5 mL of a 10% by mass surfactant (alkylbenzene sulfonate, Neogen SC-A, manufactured by Dai-Ichi Kogyo Seiyaku Co., Ltd.), and to this 0.5 g of each toner is added and stirred by microspartel, followed by adding 80 mL of ion-exchanged water. The obtained dispersion liquid is dispersed with an ultrasonic wave disperser (W-113MK-II, manufactured by Honda Electronics Co., Ltd.) for 10 minutes. The obtained dispersion liquid is subjected to the measurement by Multisizer III using ISOTON III (Beckman Coulter, Inc.) as a reagent. For the measurement, the toner sample dispersion liquid is added dropwise so that the device shows the concentration to be 8%±2%. In this measurement method, it is important that the concentration is set 8%±2% in light of the measurement reproducibility of the particle diameter. As long as the concentration is within this range, there is no error occurred in the particle diameter.

—Acid Value of Toner—

The acid value of the toner of the present invention is an important index for the low temperature fixing ability and hot offset resistance of the toner, and is derived from a terminal carboxyl group of an unmodified polyester resin. The acid value of the toner is preferably 0.5 mgKOH/g to 40 mgKOH/g in order to control the low temperature fixing ability (e.g. lowest fixing temperature, and hot offset temperature).

When the acid value is higher than 40 mgKOH/g, the elongation reaction and/or crosslink reaction of the modified polyester resin proceeds insufficiently, and this may result in poor hot offset resistance of the toner. When the acid value thereof is lower than 0.5 mgKOH/g, conversely, such an effect of the base that dispersion stability is improved may not be attained during the production of the toner, or the elongation reaction and/or crosslink reaction of the modified polyester resin tends to be accelerated, which may lower the production stability.

The acid value of the toner can be measured, for example, by the method specified in JIS K0070-1992.

The color of the toner is appropriately selected depending on the intended purpose without any restriction, and it can be selected at least one selected from the group consisting of a black toner, a cyan toner, a magenta toner, and a yellow toner. The toner of each color can be obtained by appropriately selecting the colorant for use, but the toner is preferably a color toner.

The production method of the toner is appropriately selected depending on the intended purpose without any restriction, and examples thereof include a kneading-pulverizing method, a polymerization method, a dissolution suspension method, and a spray granulation method. Examples of the polymerization method include a method for producing a toner in an aqueous medium, and an emulsification aggregation fusion method. The kneading-pulverization method, the method for producing a toner in an aqueous medium, and the emulsification aggregation fusion method will be specifically explained hereinafter.

<Method for Producing Toner in Aqueous Medium>

The method for producing a toner in an aqueous medium includes: dissolving the compound containing an active hydrogen group reactive with the binder resin precursor in an oil phase which contains an organic solvent, and at least the colorant, the releasing agent, the crystalline polyester resin, and the binder resin precursor dissolved or dispersed therein, followed by dispersing the oil phase in an aqueous medium containing a dispersant to obtain an emulsified dispersion liquid; allowing the binder resin precursor and the compound containing an active hydrogen group to react in the emulsified dispersion liquid; and removing the organic solvent from the emulsified dispersion liquid.

As the aqueous medium, water may be used alone, or in combination with a solvent miscible with water. Examples of the solvent miscible with water include alcohols (e.g. methanol, isopropanol, and ethylene glycol), dimethylformamide, tetrahydrofuran, cellosolves (e.g. methyl cellosolve), and lower ketones (e.g. acetone, and methyl ethyl ketone).

The binder resin precursor, the colorant, the releasing agent, a dispersion liquid of the crystalline polyester, the charge controlling agent, the unmodified polyester resin and the like may be added at the time when dispersed elements are formed in the aqueous medium. It is, however, more preferred that these materials be mixed in advance to form a toner material (i.e. a mixture of the materials for forming a toner) and the toner material be added and dispersed in the aqueous medium. Moreover, the toner material including the colorant, releasing agent, charge controlling agent and the like is not necessarily added at the time when particles are formed in the aqueous medium, and may be added after particles are formed. For example, the colorant is added in the conventional dying method after forming particles without including the colorant.

The dispersion method is appropriately selected depending on the intended purpose without any restriction, and examples thereof include conventional dispersers such as a low-speed shearing disperser, a high-speed shearing disperser, a friction disperser, a high-pressure jetting disperser and ultrasonic wave disperser. Among them, the high-speed shearing disperser is preferable for giving dispersed elements of 2 μm to 20 μm in the diameter.

In use of the high-speed shearing disperser, the rotating speed is appropriately selected depending on the intended purpose without any restriction, but is preferably 1,000 rpm to 30,000 rpm, more preferably 5,000 rpm to 20,000 rpm. The duration for dispersing is appropriately selected depending on the intended purpose without any restriction, but in the case of the batch system, it is preferably 0.1 minutes to 60 minutes. The temperature during the dispersing is preferably 0° C. to 80° C. (in a pressurized state), more preferably 10° C. to 40° C.

An amount of the aqueous medium is preferably 100 parts by mass to 1,000 parts by mass relative to 100 parts by mass of the toner material. When the amount of the aqueous medium is smaller than 100 parts by mass, the toner material may not be in a desirable dispersed state, and thus toner particles of the predetermined particle diameters may not be obtained. When the amount thereof is greater than 1,000 parts by mass, it is not economically desirable. Moreover, a dispersant is optionally used for the dispersing. Use of the dispersant is preferable as a sharp particle size distribution of the dispersed particles can be attained, and the dispersed state is stably maintained.

As a method for reacting the binder resin precursor (polyester prepolymer) and the compound containing an active hydrogen group, the compound containing an active hydrogen group may be added and reacted before the toner material is dispersed in the aqueous medium. Alternatively, the compound containing an active hydrogen may be added after the toner material is dispersed in the aqueous medium to thereby initiate the reaction from an interface of a particle. In the latter case, the modified polyester with the polyester prepolymer is preferentially generated on a surface of a toner base particle to be formed, so that it is possible to give a concentration deviation within the particle.

A dispersant used for dispersing the oil phase containing the toner material in the aqueous medium containing water include; anionic surfactants such as alkylbenzenesulfonic acid salts, α-olefin sulfonic acid salts and phosphoric acid esters; cationic surfactants such as amine salts (e.g., alkyl amine salts, amino alcohol fatty acid derivatives, polyamine fatty acid derivatives and imidazoline), and quaternary ammonium salts (e.g., alkyltrimethylammonium salts, dialkyl dimethylammonium salts, alkyl dimethyl benzyl ammonium salts, pyridinium salts, alkyl isoquinolinium salts and benzethonium chloride); nonionic surfactants such as fatty acid amide derivatives and polyhydric alcohol derivatives; and amphoteric surfactants such as alanine, dodecyldi(aminoethyl)glycine, di(octylaminoethyl)glycine and N-alkyl-N,N-dimethylammonium betaine.

Also, a fluoroalkyl group-containing surfactant can exhibit its dispersing effects even in a small amount. Preferable examples of the fluoroalkyl group-containing anionic surfactant include fluoroalkyl carboxylic acid having 2 to 10 carbon atoms and metal salts thereof, disodium perfluorooctanesulfonylglutamate, sodium 3-[ω-fluoroalkyl(C6-C11)oxy)-1-alkyl(C3-C4) sulfonate, sodium 3-[ω-fluoroalkanoyl(C6-C8)-N-ethylamino]-1-propanesulfonate, fluoroalkyl(C11-C20) carboxylic acid and metal salts thereof, perfluoroalkylcarboxylic acid(C7-C13) and metal salts thereof, perfluoroalkyl(C4-C12)sulfonate and metal salts thereof, perfluorooctanesulfonic acid diethanol amide, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin and monoperfluoroalkyl(C6-C16)ethylphosphate.

Examples of the commercial product of the fluoroalkyl group-containing anionic surfactant include: SURFLON S-111, S-112 and S-113 (these products are of Asahi Glass Co., Ltd.); FRORARD FC-93, FC-95, FC-98 and FC-129 (these products are of Sumitomo 3M Ltd.); UNIDYNE DS-101 and DS-102 (these products are of Daikin Industries, Ltd.); MEGAFACE F-110, F-120, F-113, F-191, F-812 and F-833 (these products are of Dainippon Ink and Chemicals, Inc.); EFTOP EF-102, 103, 104, 105, 112, 123A, 123B, 306A, 501, 201 and 204 (these products are of Tohchem Products Co., Ltd.); and FUTARGENT F-100 and F150 (these products are of NEOS COMPANY LIMITED).

Examples of the fluoroalkyl group-containing cationic surfactant include fluoroalkyl group-containing primary, secondary or tertiary aliphatic compounds, aliphatic quaternary ammonium salts (e.g., perfluoroalkyl (C6-C10) sulfonamide propyltrimethylammonium salts), benzalkonium salts, benzetonium chloride, pyridinium salts and imidazolinium salts, and product names thereof are: SURFLON S-121 (product of Asahi Glass Co., Ltd.); FRORARD FC-135 (product of Sumitomo 3M Ltd.); UNIDYNE DS-202 (product of Daikin Industries, Ltd.); MEGAFACE F-150 and F-824 (these products are of Dainippon Ink and Chemicals, Inc.); EFTOP EF-132 (product of Tohchem Products Co., Ltd.); and FUTARGENT F-300 (product of Neos COMPANY LIMITED).

Moreover, poorly water-soluble inorganic dispersing agents, such as tricalcium phosphate, calcium carbonate, titanium oxide, colloidal silica, and hydroxyapatite, can also used as the dispersing agent.

Furthermore, a polymeric protective colloid or water-insoluble organic particles may be used to stabilize dispersed droplets. Examples of the water-insoluble organic particles include: acids (e.g., acrylic acid, methacrylic acid, α-cyanoacrylic acid, α-cyanomethacrylic acid, itaconic acid, crotonic acid, fumaric acid, maleic acid and maleic anhydride); hydroxyl group-containing (meth)acrylic monomers (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylolacrylamide and N-methylolmethacrylamide), vinyl alcohol and ethers thereof (e.g., vinyl methyl ether, vinyl ethyl ether and vinyl propyl ether), esters formed between vinyl alcohol and a carboxyl group-containing compound (e.g., vinyl acetate, vinyl propionate and vinyl butyrate); acrylamide, methacrylamide, diacetone acrylamide and methylol compounds of thereof; acid chlorides (e.g., acrylic acid chloride and methacrylic acid chloride); nitrogen-containing compounds and nitrogen-containing heterocyclic compounds (e.g., vinyl pyridine, vinyl pyrrolidone, vinyl imidazole and ethyleneimine); polyoxyethylenes (e.g., polyoxyethylene, polyoxypropylene, polyoxyethylene alkyl amines, polyoxypropylene alkyl amines, polyoxyethylene alkyl amides, polyoxypropylene alkyl amides, polyoxyethylene nonylphenyl ethers, polyoxyethylene laurylphenyl ethers, polyoxyethylene stearylphenyl esters and polyoxyethylene nonylphenyl esters); and celluloses (e.g., methyl cellulose, hydroxyethyl cellulose and hydroxypropyl cellulose).

When an acid- or alkali-soluble compound (e.g., calcium phosphate) is used as a dispersion stabilizer, it is preferred that the calcium phosphate used be dissolved with an acid (e.g., hydrochloric acid), followed by washing with water, to thereby remove it from the formed fine particles (toner particles). Also, the calcium phosphate may be removed through enzymatic decomposition.

Alternatively, the dispersing agent used may remain on the surfaces of the toner particles. But, the dispersing agent is preferably removed through washing in terms of charging ability of the formed toner.

Furthermore, in order to decrease the viscosity of the toner material, there can be used a solvent in which a modified polyester obtained through reaction of polyester prepolymers can be dissolved. Use of the solvent is preferred from the viewpoint of attaining a sharp particle size distribution. The solvent used is preferably a volatile solvent having a boiling point lower than 100° C., since solvent removal can be easily performed. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These may be used independently, or in combination. Among them, the aromatic solvents such as toluene and xylene, and the halogenated hydrocarbons such as methylene chloride, 1,2-dichloroethane, chloroform, and carbon tetrachloride are preferable.

An amount of the solvent to 100 parts by mass of the polyester prepolymer is preferably 300 parts by mass or less, more preferably 100 parts by mass or less, and even more preferably 25 parts by mass to 70 parts by mass. When the solvent is used, the solvent is preferably removed by heating under the normal pressure or reduced pressure, after the elongation and/or crosslink reaction.

The duration for the elongation and/or crosslink reaction is appropriately adjusted depending on the reactivity owing to the combination of the polyester prepolymer and the compound containing an active hydrogen group, but it is preferably 10 minutes to 40 hours, more preferably 30 minutes to 24 hours. The reaction temperature is preferably 0° C. to 100° C., more preferably 10° C. to 50° C. Moreover, a conventional catalyst may be used, if necessary. Specific examples of the catalyst include: tertiary amine such as triethyl amine; and imidazole.

In order to remove the organic solvent from the obtained emulsified dispersion liquid, such a method is employed that the entire liquid is gradually heated to completely evaporate and remove the organic solvent contained in the dispersed droplets. It is also possible that the emulsified dispersion liquid is sprayed in a dry atmosphere to completely evaporate and remove the water-insoluble organic solvent in the droplets to thereby form toner particles, at the same time as evaporating and removing the aqueous dispersant. As for the dry atmosphere in which the emulsified dispersion liquid is sprayed, heated gas (e.g., air, nitrogen, carbon dioxide and combustion gas), especially, gas flow heated to a temperature equal to or higher than the boiling point of the solvent for use, is generally used. By removing the organic solvent even in a short time using, for example, a spray dryer, a belt dryer or a rotary kiln, the resultant product has satisfactory quality.

In the case where the particle size distribution of the emulsified and/or dispersed particles is broad, and washing and drying are performed on the particles with the same broad particle size distribution, the particle size distribution of the washed and dried particles can be controlled to have the predetermined particle size distribution by classification.

Classification is performed by removing very fine particles using a cyclone, a decanter, a centrifugal separator, etc. in the liquid. Needless to say, classification may be performed on powder obtained after drying but is preferably performed in the liquid from the viewpoint of high efficiency. In this case, the fine particles or coarse particles may be in the wet state.

The used dispersing agent is preferably removed from the obtained dispersion liquid to the greatest extent possible.

Preferably, the dispersing agent is removed at the same time as the above-described classification is performed.

The resultant dry toner particles may be mixed with other particles such as releasing agent fine particles, charge controlling agent fine particles and colorant fine particles, and also a mechanical impact may be applied to the mixture for immobilization or fusion of other particles on the toner surface, to thereby prevent the other particles from dropping off from the surfaces of the toner particles.

Specific examples of the method for mixing or applying a mechanical impact include a method in which an impact is applied to a mixture using a high-speed rotating blade, and a method in which an impact is applied by putting mixed particles into a high-speed air flow and accelerating the air speed such that the particles collide against one another or that the particles are crashed into a proper collision plate. Examples of apparatuses used in these methods include ANGMILL (product of Hosokawa Micron Corporation), an apparatus produced by modifying I-type mill (product of Nippon Pneumatic Mfg. Co., Ltd.) so that the pulverizing air pressure thereof is decreased, a hybridization system (product of Nara Machinery Co., Ltd.), a kryptron system (product of Kawasaki Heavy Industries, Ltd.) and an automatic mortar.

<Production Method of Toner According to Emulsification Aggregation Fusion Method>

The production method of the toner according to the emulsification aggregation fusion method include: dispersing the crystalline polyester resin, and a non-crystalline polyester resin, respectively in separate aqueous media to emulsify the crystalline polyester and the non-crystalline polyester as crystalline polyester resin particles, and non-crystalline polyester resin particles, respectively; mixing the crystalline polyester resin particles, the non-crystalline polyester resin particles, a wax dispersion liquid in which the releasing agent is dispersed, and a colorant dispersion liquid in which the colorant is dispersed to prepare an aggregated particle dispersion liquid in which aggregated particles are dispersed; and heating the aggregated particle dispersion liquid to a temperature equal to or higher than a glass transition temperature of the resin contained in the aggregated particles to fuse and combine the aggregated particles to thereby form toner particles; and may further contain an annealing step, and other steps, if necessary.

Mixing the resin particle dispersion liquid prepared by emulsification dispersion, the separately prepared colorant dispersion liquid, and optionally the releasing agent dispersion liquid (the wax dispersion liquid) to cause aggregations of the materials to thereby form aggregated particles is referred to as an aggregated particle dispersion liquid preparation step (may also be referred to as a "aggregation step" hereinafter), and heating and fusing the aggregated particles to form toner particles is referred to as a toner particle forming step (may also be referred to as a "fusing step" hereinafter). The production method of the toner includes the aggregation step and the fusing step.

In the aggregation step, the aggregated particles are formed by heteroaggregation or the like. During the formation of the aggregated particles, an ionic surfactant having the opposite polarity to that of the aggregated particles, and/or a compound having a monovalent or higher electric charge, such as a metal salt may be added for the purpose of stabilizing the aggregated particles, and controlling the particle diameters and/or particle size distribution of the aggregated particles. In the fusing step, heating is performed at the temperature equal to or higher than the glass transition temperature of the resin contained in the aggregated particles to fuse the aggregated particles.

Prior to the fusing step, a deposition step may be performed. The deposition step is adding and mixing a dispersion liquid of other fine particles to the aggregated particle dispersion liquid to uniformly deposit fine particles on surfaces of the aggregated particles to form deposited particles.

The fused particles formed by fusing in the fusing step are present as a color fused particle dispersion liquid in the aqueous medium. In a washing step, the fused particles are separated from the aqueous medium, at the same time as removing the impurities and the like mixed in each steps. The separated particles are then dried to thereby obtain a latent electrostatic developing toner as a powder.

In the washing step, acidic water, or base water in some cases, is added to fused particles in an amount that is a few times the amount of the fused particles, and the resultant is stirred, followed by filtering the resultant to separate a solid component. To this, pure water is added in an amount that is a few times the amount of the solid component, and the resultant is stirred, followed by filtration. This operation is repeated few times until pH of the filtrate after filtration becomes approximately 7, to thereby obtain colored toner particles. In the drying step, the toner particles obtained in the washing step is dried at the temperature lower than the glass transition temperature of the toner particles. During the heating, dry air may be circulated, or heating is performed in the vacuumed condition, if necessary.

The fusing is performed by heating the aggregated particles at the temperature equal to or higher than the glass transition temperature of the resin contained in the aggregated particles. In the case where the crystalline polyester resin and the non-crystalline polyester resin are used in combination, they become the compatible state by the heating. Therefore, an annealing is performed. The annealing can be performed before or during the washing step, or during or after the drying step.

As mentioned above, the annealing is preferably performed at the temperature that is the onset temperature ±5° C., where the onset temperature is calculated from the DSC curve of the crystalline polyester resin as measured by differential scanning calorimeter with elevating temperature.

In order to stabilize the dispersibilities of the resin particle dispersion liquid, the colorant dispersion liquid, and the releasing agent dispersion liquid, a surfactant can be used.

Examples of the surfactant include: an anionic surfactant such as such as a sulfuric acid ester salt-based surfactant, a sulfonic acid salt-based surfactant, a phosphoric acid ester-based surfactant, and a soap-based surfactant; a cationic surfactant such as an amine salt-based surfactant, a quaternary ammonium salt-based surfactant; and an nonionic surfactant such as a polyethylene glycol-based surfactant, an alkylphenol ethylene oxide adduct-based surfactant, and a polyhydric alcohol-based surfactant. Among them, the ionic surfactant is preferable, and the anionic surfactant and the cationic surfactant are more preferable. Since the anionic surfactant generally has strong dispersing ability, and is excellent in dispersing resin particles and a colorant, the anionic surfactant is advantageously used as a dispersant for dispersing the releasing agent in the production of the toner of the present invention. The nonionic surfactant is preferably used in combination with the anionic surfactant or cationic surfactant. The surfactant may be used independently, or in combination.

Examples of the anionic surfactant include: fatty acid soaps such as potassium laurate, sodium oleate, and caster oil sodium salt; sulfuric acid esters such as octyl sulfate, lauryl sulfate, lauryl ether sulfate, and nonylphenyl ether sulfate; sulfonic acid salts such as lauryl sulfonate, dodecylbenzene sulfonate, alkylnaphthalene sulfonate (e.g. triisopropylnaphthalene sulfonate, and dibutylnaphthalene sulfonate), naphthalene sulfonate-formalin condensate, monooctylsulfosuccinate, dioctylsulfosuccinate, lauric acid amide sulfonate, and oleic acid amide sulfonate; phosphoric acid esters such as lauryl phosphate, isopropyl phosphate, and nonylphenyl ether phosphate; and sulfosuccinic acid salts such as dialkylsulfosuccinic acid salts (e.g. sodium dioctylsulfosuccinate), and 2-sodium lauryl sulfossucinate.

Examples of the cationic surfactant include: amine salts such as lauryl amine hydrochloride, stearyl amine hydrochloride, oleyl amine hydrochloride, stearyl amine acetate, and stearylaminopropyl amine acetate; and quaternary ammonium salts such as lauryl trimethyl ammonium chloride, dilauryl dimethyl ammonium chloride, distearyl ammonium chloride, distearyl dimethyl ammonium chloride, lauryl dihydroxyethylmethyl ammonium chloride, oleyl bispolyoxyethylene methyl ammonium chloride, lauroyl aminopropyl dimethyl ethyl ammonium ethosulfate, lauroyl aminopropyl dimethyl hydroxyethyl ammonium perchlorate, alkylbenzene dimethyl ammonium chloride, and alkyltrimethyl ammonium chloride.

Examples of the nonionic surfactant include: alkyl ethers such as polyoxyethylene octyl ether, polyoxyethylene lauryl ether, polyoxyethylene stearyl ether, and polyoxyethylene oleyl ether; alkylphenyl ethers such as polyoxyethylene octylphenyl ether, and polyoxyethylene nonylphenyl ether; alkyl esters such as polyoxyethylene laurate, polyoxyethylene stearate, and polyoxyethylene oleate; alkyl amines such as polyoxyethylene laurylamino ether, polyoxyethylene stearylamino ether, polyoxyethylene oleylamino ether, polyoxyethylene soy-amino ether, and polyoxyethylene beef tallow-amino ether; alkyl amides such as polyoxyethylene lauric acid amide, polyoxyethylene stearic acid amide, and polyoxyethylene oleic acid amide; vegetable oil ethers such as polyoxyethylene caster oil ether, and polyoxyethylene rapeseed oil ether; alkanol amides lauric diethanolamide, stearic diethanolamide, and oleic diethanolamide; and sorbitan ester ethers such as polyoxyethylene sorbitan monolaurate, polyoxyethylene sorbitan monopalmitate, polyoxyethylene sorbitan monostearate, and polyoxyethylene sorbitan monooleate.

An amount of the surfactant in each dispersion liquid is appropriately selected depending on the intended purpose without any restriction, but it is generally small. Specifically, in the case of the resin particle dispersion liquid, the amount of the surfactant is preferably 0.01% by mass to 1% by mass, more preferably 0.02% by mass to 0.5% by mass, and even more preferably 0.1% by mass to 0.2% by mass. When the amount thereof is smaller than 0.01% by mass, aggregation may occur in the state where pH of the resin particle dispersion liquid is not sufficiently base.

In the case of the colorant dispersion liquid and the releasing agent dispersion liquid, an amount of the surfactant is preferably 0.01% by mass to 10% by mass, more preferably 0.1% by mass to 5% by mass, and even more preferably 0.5% by mass to 0.2% by mass. When the amount thereof is smaller than 0.01% by mass, stability between particles varies during the aggregation and therefore some particles may be isolated. When the amount thereof is greater than 10% by mass, the particle size distribution of the particles is broad, and thus it may be difficult to control the particle diameters.

To the toner, other than the binder resin, colorant, and releasing agent, particles of other substances, such as internal additive, charge controlling agent, inorganic particles, organic particles, a lubricant, abrasives, and the like can be added depending on the intended purpose.

The internal additive is in an amount not to adversely affect the electrostatic propensity, which is one of the characteristics of the toner, and is for example a magnetic material, such as a metal (e.g. ferrite, magnetite, reduced iron, cobalt, manganese, and nickel), an alloy, or a compound containing the preceding metals.

The charge controlling agent is appropriately selected depending on the intended purpose without any restriction, and is preferably a colorless, or pale colored material especially used for a color toner. Examples thereof include a quaternary ammonium salt compound, a nigrosin-based compound, a dye consisted of a complex of aluminum, iron, or chromium, and a triphenylmethane-based pigment.

Examples of the inorganic particles include all the particles generally used as the external additive on a surface of the toner particle, such as silica, titania, calcium carbonate, magnesium carbonate, tricalcium phosphate, and cerium oxide.

Examples of the organic particles include all the particles generally used as the external additive on a surface of the toner such as a vinyl resin, a polyester resin, and a silicone resin. Note that, these inorganic particles and organic particles can be used as a flow improving agent, and cleaning auxiliaries. Examples of the lubricant include; fatty acid amide such as ethylene bisstearic acid amide, and oleic acid amide; and fatty acid metal salts such as zinc stearate, and calcium stearate. Examples of the abrasives include those mentioned above, such as silica, alumina, and cerium oxide.

When the resin particle dispersion liquid, a dispersion liquid of a layered inorganic mineral at least in part of which has been modified with organic ions, the colorant dispersion liquid, and the releasing agent dispersion liquid are mixed together, an amount of the colorant for use is not particularly restricted as long as it is 50% by mass or smaller, and it is preferably 2% by mass to 40% by mass. An amount of the layered inorganic mineral at least in part of which has been modified with organic ions is preferably 0.05% by mass to 10% by mass. Moreover, amounts of other components are not particularly restricted as long as they do not adversely affect the obtainable effect of the present invention, and are generally very small. Specifically, the total amount of other components is preferably 0.01% by mass to 5% by mass, more preferably 0.5% by mass to 2% by mass.

As a dispersion medium in the resin particle dispersion liquid, the dispersion liquid of the layered inorganic mineral at least in part of which has been modified with organic ions, the colorant dispersion liquid, the releasing agent dispersion liquid, and the dispersion liquid of other components, for example, an aqueous medium is used. Examples of the aqueous medium include: water such as distilled water, and ion-exchanged water; and alcohols. These may be used independently, or in combination.

During the preparation of the aggregated particle dispersion liquid, the emulsifying power of the emulsifying agent is adjusted with pH to thereby allow aggregation to occur so that the resulting aggregated particles can be controlled. At the same time as the above, an aggregating agent may be added in order to stably and promptly form aggregated particles with a narrow particle size distribution. The aggregating agent is preferably a compound having monovalent or higher electric charge. Specific examples of the aggregating agent include: a water-soluble surfactants such as an ionic surfactant, and a nonionic surfactant; acids, such as chloric acid, sulfuric acid, nitric acid, acetic acid, and oxalic acid; metal salts of inorganic acids such as magnesium chloride, sodium chloride, aluminum sulfate, calcium sulfate, ammonium sulfate, aluminum nitrate, silver nitrate, copper nitrate, and sodium carbonate; metal salts of aliphatic acids or aromatic acids, such as sodium acetate, potassium formate, sodium oxalate, sodium phthalate, and potassium salicylate; metal salts of phenols such as sodium phenolate; metal salts of amino acids; and inorganic acid salts of aliphatic or aromatic amines such as triethanol amine hydrochloride, and aniline hydrochloride. In the light of the stability of aggregated particles, the stability of the aggregating agent to heat or time-lapse, and the removability thereof during washing, the metal acid of the inorganic acid is preferable as the aggregating agent in terms of its performance, and usability.

An amount of the aggregating agent for use varies depending on the valency of the electric charge, but it is small in any case. In the case of the monovalent aggregating agent, an amount thereof is approximately 3% by mass or smaller. In the case of the bivalent aggregating agent, an amount thereof is approximately 1% by mass or smaller. In the case of the trivalent aggregating agent, an amount thereof is approximately 0.5% by mass or smaller. The smaller amount of the aggregating agent is more preferable. The compound with more valency is preferable as the aggregating agent, as the amount thereof can be kept small.

<Production Method of Toner by Pulverization Method>

The production method of the toner according to the pulverization method includes: melting and kneading the toner material containing at least the crystalline polyester resin, and the non-crystalline polyester resin; pulverizing the obtained melt kneaded product; and classifying the pulverized product, and may further contain a surface treatment step, an annealing step, and other steps, if necessary.

In the annealing, annealing is preferably performed, as described above, at the temperature that is the onset temperature ±5° C., where the onset temperature is calculated from the DSC curve of the crystalline polyester resin as measured by the differential scanning calorimeter with elevating temperature.

In the melting and kneading (i.e. melt-kneading), materials for forming a toner are mixed to form a toner material (a mixture of the materials), and the toner material is set in a melt-kneader to subject to melt-kneading. As the melt-kneader, for example, monoaxial or biaxial continuous kneader, or a batch-type kneader with a roll mill can be used. Preferable examples thereof include a twin screw extruder KTT manufactured by KOBE STEEL, LTD., an extruder TEM manufactured by TOSHIBA MACHINE CO., LTD., a twin screw extruder manufactured by ASADA WORKS CO., LTD., a twin screw extruder PCM manufactured by Ikegai Corp., and a cokneader manufactured by Buss. The melt-kneading is preferably performed under the appropriate conditions so as not to cause scission of molecular chains of the binder resin. Specifically, the temperature of the melt-kneading is adjusted under taking the softening point of the binder resin as consideration. When the temperature of the melt-kneading is very high compared to the softening point, the scission occurs significantly. When the temperature thereof is very low compared to the softening point, the dispersing may not be progressed.

The pulverizing is pulverizing the kneaded product obtained in the melt-kneading. In the pulverizing, it is preferred that the kneaded product be initially pulverized roughly, and then finely pulverized. For the pulverizing, a method in which the kneaded product is pulverized by making the kneaded product to crush into an impact plate in the jet stream, a method in which particles of the kneaded product are made crushed each other in the jet stream to thereby pulverize the kneaded product, or a method in which the kneaded product is pulverized in a narrow cap between a mechanically rotating rotor and a stator is preferably used.

The classifying is classifying the pulverized product obtained by the pulverizing into particles having the predetermined particle diameters. The classifying can be performed by removing the fine particles component by means of a cyclone, a decanter, a centrifugal separator, or the like.

After the completion of the pulverizing and the classifying, the classified pulverized product is classified in an air stream by centrifugal force or the like to thereby produce toner base particles having the predetermined particle diameters.

Next, external additives are added to the obtained toner base particles. The toner base particles and the external additives are mixed and stirred by means of a mixer to thereby crush the external additives and coat a surface of the toner base particle with the external additives. It is important that the external additive such as inorganic particles and resin particles are uniformly and solidly adhered onto the toner base particles in light of the durability of the resulting toner.

(Developer)

The developer of the present invention contains at least the toner of the present invention, and may further contain appropriately selected other components, such as a carrier. The developer may be a one-component developer, or two-component developer.

—Carrier—

The carrier is appropriately selected depending on the intended purpose without any restriction, but the carrier preferably contains a core and a resin layer coating the core.

The material of the core is appropriately selected from the conventional materials known in the art, and is preferably, for example, selected from a manganese-strontium (Mn—Sr) based material of 50 emu/g to 90 emu/g, a manganese-magnesium (Mn—Mg) based material of 50 emu/g to 90 emu/g. In order to attain secure a sufficient image density, use of a high magnetic material, such as iron powder (100 emu/g or higher) and magnetite (75 emu/g to 120 emu/g), is preferable. Moreover, a weak magnetic material such as a cupper-zinc (Cu—Zn) based material (30 emu/g to 80 emu/g) is preferable because the resulting carrier enables to reduce the impact of the toner brush onto a photoconductor, and therefore it is advantageous for forming high quality images. These may be used independently, or in combination.

The volume average particle diameter of the core is preferably 10 μm to 150 μm, more preferably 40 μm to 100 μm. When the average particle diameter (volume average particle diameter ($D_{50}$)) of the core is smaller than 10 μm, the proportion of the fine particles in the particle size distribution of the carrier increases, and therefore the magnetization per carrier particle is small, which may cause scattering of the carrier. When the average particle diameter thereof is larger than 150 μm, the specific area of the resulting particle of the carrier is small, which may cause scattering of the carrier. Use of the core in such the size may lower the reproducibility of an image especially in a solid imaging part, when a full color image having a large area of the solid image part is printed.

The material of the resin layer is appropriately selected depending on the intended purpose without any restriction. Examples thereof include an amino-based resin, a polyvinyl-based resin, a polystyrene-based resin, a halogenated olefin resin, a polyester-based resin, a polycarbonate-based resin, a polyethylene resin, a polyvinyl fluoride resin, a polyvinylidene fluoride resin, a polytrifluoroethylene resin, a polyhexafluoropropylene resin, a copolymer of vinylidene fluoride and an acrylic monomer, a copolymer of vinylidene fluoride and vinyl fluoride, a fluoroterpolymer (e.g. a terpolymer of tetrafluoroethylene, vinylidene fluoride, and non-fluoride monomer), and a silicone resin. These may be used independently, or in combination.

Examples of the amino-based resin include a urea-formaldehyde resin, a melamine resin, a benzoguanamine resin, a urea resin, a polyamide resin, and an epoxy resin. Examples of the polyvinyl-based resin include an acryl resin, polymethyl methacrylate, polyacrylonitrile, polyvinyl acetate, polyvinyl alcohol and polyvinyl butyral. Examples of the polystyrene-based resin include polystyrene, and a styrene-acryl copolymer. Examples of the halogenated olefin resin include polyvinyl chloride. Examples of the polyester-based resin include polyethylene terephthalate, and polybutylene terephthalate.

Moreover, the resin layer may contain conductive powder, if necessary. Examples of the material of the conductive powder include metal, carbon black, titanium oxide, tin oxide and zinc oxide. The average particle diameter of the conductive powder is preferably 1 μm or smaller. When the average particle diameter thereof is larger than 1 μm, it may be difficult to control the electric resistance.

The resin layer can be formed, for example, by preparing a coating liquid by dissolving a silicone resin or the like in a solvent, applying the coating liquid onto the surface of the core by the conventional coating method, drying and baking the coating liquid. Examples of the coating method include dip coating, spray coating, and brush coating.

The solvent is appropriately selected depending on the intended purpose without any restriction, and examples thereof include toluene, xylene, methyl ethyl ketone, methyl isobutyl ketone, cellosolve, and butyl acetate.

The baking method is not particularly restricted, and may be of external heating or internal heating. Examples of the baking method include methods using a fixed-type electric furnace, a flow-type electric furnace, a rotary electric furnace, a burner furnace, or micro waves.

An amount of the resin layer in the carrier is preferably 0.01% by mass to 5.0% by mass. When the amount of the resin layer is smaller than 0.01% by mass, a uniform resin layer may not be formed on a surface of the core particle. When the amount thereof is greater than 5.0% by mass, a thickness of the resulting resin layer is excessively thick so that the resulting carrier may cause aggregations so that uniform carrier particles may not be obtained.

In the case where the toner of the present invention is used as a two-component developer, the toner is mixed with the carrier. The mixing ratio of the carrier and the toner in the developer is preferably such that an amount of the toner is 1 part by mass to 10 parts by mass relative to 100 parts by mass of the carrier.

The toner and developer of the present invention have excellent low temperature fixing ability, and desirable offset resistance, and are capable of forming high quality images with excellent sharpness over a long period without causing filming of a crystalline polyester resin. Therefore, the toner is particularly suitably used for a toner container, and a developer, and the toner and the developer are particularly suitably used in a process cartridge and image forming apparatus, and for an image forming method.

As for a fixing member of the image forming apparatus in which the toner of the present invention is used, a fixing member equipped with a roller fixing system or belt fixing system is suitably used.

EXAMPLES

Examples of the present invention will be explained hereinafter, but these examples shall not be construed as to limit the scope of the present invention in any way.

In Examples and Comparative Examples, the DSC measurement of the toner, and measurements for the weight average molecular weight (Mw) of the crystalline polyester resin, a proportion of the crystalline polyester resin having the number average molecular weight (Mn) of 500 or smaller, a proportion of the crystalline polyester resin having the number average molecular weight (Mn) of 1,000 or smaller, the acid value of the toner, the hydroxyl value of the toner, the glass transition temperature (Tg) of the toner, the melting point of the crystalline polyester resin, the melting point of the wax, and the volume average particle diameter (Dv) and particle size distribution (Dv/Dn) of the toner were performed in the following manners.

<DSC Measurement of Toner>

The measurement of the toner was performed in the following manner.

A differential scanning calorimeter, DSC System Q-200, manufactured by TA INSTRUMENTS JAPAN INC. was used for the measurement. At first, an aluminum sample container was charged with about 5 mg of the toner, and the holder unit is set in an electric furnace. The sample container was placed on a holder unit, and set in an electric furnace. Next, in a nitrogen atmosphere (flow rate: 50 mL/min), the sample was heated from −20° C. to 150° C. at a temperature increasing rate of 1° C./min, temperature modulation cycle of 60 seconds, and temperature modulation amplitude of 0.159° C. Thereafter, the sample was cooled from 150° C. to 0° C. at a temperature decreasing rate of 10° C./min. In this process, a DSC curve of the sample was measured with a differential scanning calorimeter (Q-200, TA INSTRUMENTS JAPAN INC.). From the obtained the DSC curve, an endothermic peak of the DSC curve during the initial temperature elevation was selected, and a temperature width of the curve at the position where the height thereof was ⅓ of the height from the base line to the top of the endothermic peak. The peak temperature was a top peak temperature of the endothermic peak (the direction where the value of heat flow (W/g) was minus indicated endotherm).

The "onset temperature X" was a temperature at the intersection between the base line and a tangent line drawn at the point at which a peak curve of the endothermic peak derived from the endothermic peak gave the maximum derivative (see FIG. 1).

The "endset temperature Y" was, comparative with the onset temperature which corresponded to endothermic onset, a temperature at the intersection between the base line and the point on the peak curve indicating the endothermic endset (see FIG. 1).

<Weight Average Molecular Weight (Mw) of Crystalline Polyester Resin, Proportion of Crystalline Polyester Resin Having Number Average Molecular Weight (Mn) Having 500 or Smaller, Proportion of Crystalline Polyester Resin Having Number Average Molecular Weight (Mn) of 1,000 or Smaller>

Gel permeation chromatography (GPC) measuring device: GPC-8220GPC (Tosoh Corporation)

Column: TSKgel SuperHZM-H, 15 cm, three connected columns (Tosoh Corporation)

Temperature: 40° C.

Solvent: THF

Flow rate: 0.35 mL/min

Sample: 0.4 mL of a 0.15% sample to be supplied

Pretreatment of sample: The sample was dissolved in tetrahydrofuran (THF containing a stabilizer, manufactured by Wako Chemical Industries, Ltd.) to give a concentration of 0.15% by mass, the resulting solution was then filtered through a filter having a pore size of 0.2 μm, and the filtrate from the filtration was used as a sample. The measurement was performed by supplying 100 μL of the tetrahydrofuran (THF) sample solution. For the measurement of the molecular weight of the sample, the molecular weight distribution of the sample was calculated from the relationship between the logarithmic value of the calibration curve prepared from a several monodispersible polystyrene standard samples and the number of counts. As the standard polystyrene samples for preparing the calibration curve, Showdex STANDARD Std. Nos. S-7300, S-210, S-390, S-875, S-1980, S-10.9, S-629, S-3.0, and S-0.580 of SHOWA DENKO K.K., and toluene were used. As the detector, a refractive index (RI) detector was used.

<Measurement of Acid Value and Hydroxyl Value>

The acid value (AV) and hydroxyl value (OHV) were determined in the specifically following manner. Note that a solvent, e.g. dioxane or tetrahydrofuran (THF) was used in the case where the sample was not dissolved.

Measuring device: a potentiometric automatic titrator DL-53 (product of Mettler-Toledo K.K.)

Used electrode: DG113-SC (product of Mettler-Toledo K.K.)

Analysis software: LabX Light Version 1.00.000

Calibration of device: a mixed solvent of 120 mL of toluene and 30 mL of ethanol Measurement temperature: 23° C.

The measurement conditions were as follow:

Stir
- Speed [%] 25
- Time [s] 15

EQP titration
- Titrant/Sensor
- Titrant $CH_3ONa$
- Concentration [mol/L] 0.1
- Sensor DG115
- Unit of measurement mV
- Predispensing to volume
- Volume [mL] 1.0
- Wait time [s] 0
- Titrant addition Dynamic
- dE(set) [mV] 8.0
- dV(min) [mL] 0.03
- dV(max)[mL] 0.5
- Measure mode Equilibrium controlled
- dE [mV] 0.5
- dt [s] 1.0
- t(min) [s] 2.0
- t(max) [s] 20.0
- Recognition
- Threshold 100.0
- Steepest jump only No
- Range No
- Tendency None
- Termination
- At maximum volume [mL] 10.0
- At potential No
- At slope No
- After number EQPs Yes
- n=1
- comb. Termination conditions No
- Evaluation
- Procedure Standard
- Potential 1 No
- Potential 2 No
- Stop for reevaluation No —Measuring Method of Acid Value—

The acid value was measured in accordance with the measuring method specified in JIS K0070-1992 under the following conditions.

Preparation of sample: 0.5 g of a toner (0.3 g of the ethyl acetate soluble component) was added to 120 mL of toluene, and the mixture was stirred at about 10 hours at room temperature (23° C.) to thereby dissolve the sample. To this, 30 mL of ethanol was further added to thereby prepare a sample solution.

For the measurement of the acid value, the calculation could be performed by the device mentioned above. Specifically, it was calculated in the following manner.

The sample solution was titrated with a pre-standardized N/10 potassium hydroxide/alcohol solution and then the acid value was calculated from the consumed amount of the alcohol potassium liquid.

$$\text{Acid value}=\text{KOH(mole number)}\times N\times 56.1/\text{sample mass}$$

(N is a factor of (N/10)KOH)

—Measuring Method of Hydroxyl Value—

A sample (0.5 g) was accurately weighed in a 100 mL measuring flask, and then 5 mL of an acetylation reagent was added thereto. Thereafter, the measuring flask was heated for 1 hour to 2 hours in a hot water bath set to 100° C.±5° C., and was then taken out from the hot water bath and left to cool. Then, the flask was shaken to decompose acetic anhydride. In order to decompose acetic anhydride completely, the flask was again heated in the hot water bath for 10 minutes or longer, followed by taking the flask out from the hot water bath and leaving to cool. Thereafter, the wall of the flask was washed well with an organic solvent. This liquid was subjected to potentiometric titration with N/2 potassium hydroxide ethylalcohol solution using the electrode to thereby determine a hydroxyl value (following JIS K0070-1966).

<Glass Transition Temperature (Tg)>

The glass transition temperature (Tg) was determined specifically in the following manner. As a measuring device, TA-60WS and DSC-60 of Shimadzu Corporation were used, and the measurement was performed under the following measurement conditions.

[Measurement Conditions]

Sample container: aluminum sample pan (with a lid)

Amount of sample: 5 mg

Reference: aluminum sample pan (housing 10 mg of alumina)

Atmosphere: nitrogen (flow rate of 50 mL/min)

Temperature condition

Starting temperature: 20° C.
Temperature increase rate: 10° C./min
Finish temperature: 150° C.
Retention Time: None
Temperature decrease rate: 10° C./min
Finish temperature: 20° C.
Retention time None
Temperature increase rate: 10° C./min
Finish temperature: 150° C.

The measured results were analyzed using a data analysis software (TA-60, version 1.52) of Shimadzu Corporation. The analysis method was such that a range of ±5° C. was designated with the point indicating the maximum peak at the lowest temperature side on the DrDSC curve as a center, where the DrDSC curve was the DSC differential curve of the second temperature elevation. Then, a peak temperature was obtained by using a peak analysis function of the analysis software. Next, the maximum endothermic temperature of the DSC curve was obtained by using the peak analysis function of the analysis software on the range of the peak temperature of the DSC curve +5° C., and −5° C. The indicated temperature here corresponds to the glass transition temperature (Tg).

<Measurements of Volume Average Particle Diameter (Dv) and Particle Size Distribution (Dv/Dn) of Toner>

The volume average particle diameter (Dv) and number average particle diameter (Dn) of the toner was determined by measuring the toner by means of a particle analyzer (Coulter Multisizer III, manufactured by Beckman Coulter, Inc.) with the aperture diameter of 100 μm, and analyzing using an analysis software (Beckman Coulter Multisizer 3 Version 3.51).

Specifically, a 100 mL glass beaker was charged with 0.5 mL of a 10% by mass surfactant (alkylbenzene sulfonate, Neogen SC-A, manufactured by Dai-Ichi Kogyo Seiyaku Co., Ltd.), and to this 0.5 g of each toner was added and stirred by microspartel, followed by adding 80 mL of ion-exchanged water. The obtained dispersion liquid was dispersed with an ultrasonic wave disperser (W-113MK-II, manufactured by Honda Electronics Co., Ltd.) for 10 minutes. The obtained dispersion liquid was subjected to the measurement by Multisizer III using ISOTON III (Beckman Coulter, Inc.) as a reagent. For the measurement, the toner sample dispersion liquid was added dropwise so that the device shows the concentration to be 8%±2%. In this measuring method, it was important that the concentration was set 8%±2% in light of the measurement reproducibility of the particle diameter. As long as the concentration was within this range, there was no error occurred in the particle diameter.

<Melting Points of Crystalline Polyester Resin and Wax>

The melting points of the crystalline polyester resin and wax were determined by measuring the maximum endothermic peak using a differential scanning calorimeter, TG-DSC system TAS-100 (manufactured by Rigaku Corporation).

Production Example 1

—Synthesis of Crystalline Polyester Resin 1—

A 5 L four-neck flask equipped with a nitrogen-introducing pipe, a drainpipe, a stirrer and a thermocouple was charged with 2,500 g of 1,12-decanediol, 2,330 g of 1,8-octanedioic acid, and 2.9 g of hydroquinone, and the mixture was allowed to for 30 hours at 180° C., then for 10 hours at 200° C., followed by reacting for 15 hours at 8.3 kPa to thereby synthesize Crystalline Polyester Resin 1.

The obtained Crystalline Polyester Resin 1 was subjected to the measurements of a melting point, a weight average molecular weight (Mw), a proportion thereof having the number average molecular weight (Mn) of 500 or smaller, a proportion thereof having the number average molecular weight (Mn) of 1,000 or smaller, an acid value, and a hydroxyl value. The results are shown in Table 1.

Production Example 2

—Synthesis of Crystalline Polyester Resin 2—

A 5 L four-neck flask equipped with a nitrogen-introducing pipe, a drainpipe, a stirrer and a thermocouple was charged with 2,500 g of 1,12-decanediol, 2,330 g of 1,8-octanedioic acid, and 6.9 g of hydroquinone, and the mixture was allowed to react for 10 hours at 180° C., and then the mixture was heated to 200° C. and reacted for 4 hours, followed by reacting for 5 hours at 8.3 kPa to thereby Synthesize Crystalline Polyester Resin 2.

The obtained Crystalline Polyester Resin 2 was subjected to the measurements of a melting point, a weight average molecular weight (Mw), a proportion thereof having the number average molecular weight (Mn) of 500 or smaller, a proportion thereof having the number average molecular weight (Mn) of 1,000 or smaller, an acid value, and a hydroxyl value. The results are shown in Table 1.

Production Example 3

—Synthesis of Crystalline Polyester Resin 3—

A 5 L four-neck flask equipped with a nitrogen-introducing pipe, a drainpipe, a stirrer and a thermocouple was charged with 2,500 g of 1,12-decanediol, 2,330 g of 1,8-octanedioic acid, and 8.9 g of hydroquinone, and the mixture was allowed to react for 6 hours at 180° C., and then the mixture was heated to 200° C. and reacted for 3 hours, followed by reacting for 4 hours at 8.3 kPa to thereby Synthesize Crystalline Polyester Resin 3.

The obtained Crystalline Polyester Resin 3 was subjected to the measurements of a melting point, a weight average molecular weight (Mw), a proportion thereof having the number average molecular weight (Mn) of 500 or smaller, a proportion thereof having the number average molecular weight (Mn) of 1,000 or smaller, an acid value, and a hydroxyl value. The results are shown in Table 1.

Production Example 4

—Synthesis of Crystalline Polyester Resin 4—

A 5 L four-neck flask equipped with a nitrogen-introducing pipe, a drainpipe, a stirrer and a thermocouple was charged with 2,160 g of fumaric acid, 2,320 g of 1,6-hexanediol, and 3.9 g of hydroquinone, and the mixture was allowed to react for 15 hours at 180° C., and then the mixture was heated to 200° C. and reacted for 5 hours, followed by reacting for 4 hours at 8.3 kPa to thereby Synthesize Crystalline Polyester Resin 4.

The obtained Crystalline Polyester Resin 4 was subjected to the measurements of a melting point, a weight average molecular weight (Mw), a proportion thereof having the number average molecular weight (Mn) of 500 or smaller, a proportion thereof having the number average molecular weight (Mn) of 1,000 or smaller, an acid value, and a hydroxyl value. The results are shown in Table 1.

TABLE 1

| | Melting point (° C.) | Mw | Proportion of Mn being 500 or smaller (%) | Proportion of Mn being 1,000 or smaller (%) | Acid value (mgKOH/g) | Hydroxyl value (mgKOH/g) |
|---|---|---|---|---|---|---|
| Crystalline polyester 1 | 72 | 19,500 | 1.3 | 3.2 | 22 | 2 |
| Crystalline polyester 2 | 68 | 6,000 | 2.4 | 4.8 | 28 | 3.5 |
| Crystalline polyester 3 | 67 | 4,800 | 3.4 | 6.2 | 29 | 5 |
| Crystalline polyester 4 | 90 | 15,000 | 2.1 | 4.2 | 25 | 3.5 |

Example 1-1

—Synthesis of Non-Crystalline Polyester Resin 1—

A 5 L four-neck flask equipped with a nitrogen-introducing pipe, a drainpipe, a stirrer and a thermocouple was charged with 229 parts by mass of bisphenol A ethylene oxide 2 mole adduct, 529 parts by mass of bisphenol A propylene oxide 3 mole adduct, 100 parts by mass of isophthalic acid, 108 parts by mass of terephthalic acid, 46 parts by mass of adipic acid and 2 parts by mass of dibutyl tin oxide. The mixture was allowed to react for 10 hours at 230° C. under normal pressure, and further reacted for another 5 hours under reduced pressure of 10 mmHg to 15 mmHg. After the reaction, 30 parts of trimellitic anhydride was added to the reaction vessel, and the mixture was allowed to react for 3 hours at 180° C. under normal pressure to thereby synthesize Non-Crystalline Polyester Resin 1.

The obtained non-crystalline polyester resin 1 had the number average molecular weight (Mn) of 1,800, weight average molecular weight (Mw) of 5,500, glass transition temperature (Tg) of 50° C., and acid value of 20 mgKOH/g.

—Synthesis of Polyester Prepolymer—

A reaction vessel equipped with a condenser, a stirrer and a nitrogen-introducing pipe was charged with 682 parts by mass of bisphenol A ethylene oxide 2 mole adduct, 81 parts by mass of bisphenol A propylene oxide 2 mole adduct, 283 parts by mass of terephthalic acid, 22 parts by mass of trimellitic anhydride and 2 parts by mass of dibutyl tin oxide. The resultant mixture was allowed to react for 8 hours at 230° C. under normal pressure and further react for 5 hours at a reduced pressure of 10 mmHg to 15 mmHg, to thereby synthesize Intermediate Polyester 1.

The obtained Intermediate Polyester 1 had the number average molecular weight (Mn) of 2,100, weight average molecular weight (Mw) of 9,500, glass transition temperature (Tg) of 55° C., acid value of 0.5 mgKOH/g, and hydroxyl value of 51 mgKOH/g.

Next, a reaction vessel equipped with a condenser, a stirrer and a nitrogen-introducing pipe was charged with 410 parts by mass of Intermediate Polyester 1, 89 parts by mass of isophorone diisocyanate and 500 parts by mass of ethyl acetate, and the mixture was allowed to react for 5 hours at 100° C., to thereby synthesize Prepolymer 1. The amount of free isocyanate contained in Prepolymer 1 was 1.53% by mass.

—Synthesis of Ketimine—

A reaction vessel equipped with a stirring rod and a thermometer was charged with 170 parts by mass of isophorone diisocyanate and 75 parts by mass of methyl ethyl ketone, and the mixture was allowed to react for 5 hours at 50° C., to thereby synthesize Ketimine Compound 1. The amine value of Ketimine Compound 1 was 418.

—Preparation of Master Batch (MB)—

Water (1,200 parts by mass), carbon black (Printex 35, product of Degussa) [DBP oil absorption amount=42 mL/100 mg, pH=9.5] (540 parts by mass) and the synthesized Non-Crystalline Polyester 1 (1,200 parts by mass) were mixed together with HENSCHEL MIXER (product of Mitsui Mining Co., Ltd). The resulting mixture was kneaded for 30 minutes at 150° C. with a two-roller mill, and then rolled, cooled and pulverized with a pulverizer, to thereby produce Master Batch 1.

—Preparation of Oil Phase—

A vessel equipped with a stirring rod and a thermometer was charged with 378 parts by mass of the synthesized Non-Crystalline Polyester Resin 1, 110 parts by mass of microcrystalline wax (Hi-Mic-1090, manufactured by Nippon Seiro Co., Ltd., the melting point: 68° C.), 22 parts by mass of a charge controlling agent (CCA) (salycilic acid metal complex E-84, manufactured by Orient Chemical Industries, Ltd.) and 947 parts by mass of ethyl acetate, and the mixture was heated to 80° C. with stirring. The resulting mixture was maintained its temperature at 80° C. for 5 hours and then cooled to 30° C. over 1 hour. Subsequently, the reaction vessel was charged with 500 parts by mass of Master Batch 1 and 500 parts by mass of ethyl acetate, followed by mixing the mixture for 1 hour, to thereby prepare Raw Material Solution 1.

The obtained Raw Material Solution 1 (1,324 parts by mass) was poured into a vessel, and the carbon black and wax were dispersed with a bead mill (ULTRA VISCOMILL, manufactured by AIMEX CO., Ltd.) under the following conditions: a liquid feed rate of 1 kg/hr, disc circumferential velocity of 6 m/s, 0.5 mm-zirconium beads packed to 80% by volume, and 3 passes. Next, a 65% by mass ethyl acetate solution of the synthesized Non-Crystalline Polyester 1 (1,042.3 parts by mass) was added thereto, and passed once with the bead mill under the above conditions, to thereby obtain Pigment-Wax Dispersion Liquid 1.

The solids content of the obtained Pigment-Wax Dispersion Liquid 1 was 50% by mass.

—Preparation of Crystalline Polyester Dispersion Liquid 1—

A 20 L-metal container was charged with 1,600 g of the synthesized Crystalline Polyester Resin 1, and 11,200 g of ethyl acetate, the mixture was heated at 75° C. to dissolve Crystalline Polyester Resin 1 therein, followed by quenching the resulting solution in an ice-water bath at the rate of 27° C./min. The resultant was dispersed by a bead mill (LMZ2, manufactured by Ashizawa Finetech Ltd.) under the following conditions: 0.3 mm-zirconium beads packed to 85% by volume, 20 passes, and the temperature of the sealing liquid of the bead mill shaft being 18° C., to thereby prepare Crystalline Polyester Dispersion Liquid 1.

—Preparation of Crystalline Polyester Dispersion Liquid 2—

Crystalline Polyester Dispersion Liquid 2 was prepared in the same manner as in the preparation of Crystalline Polyester Dispersion Liquid 1, provided that Crystalline Polyester Resin 1 was replaced with Crystalline Polyester Resin 2.

—Preparation of Crystalline Polyester Dispersion Liquid 3—

Crystalline Polyester Dispersion Liquid 3 was prepared in the same manner as in the preparation of Crystalline Polyester Dispersion Liquid 1, provided that Crystalline Polyester Resin 1 was replaced with Crystalline Polyester Resin 3.

—Preparation of Crystalline Polyester Dispersion Liquid 4—

Crystalline Polyester Dispersion Liquid 4 was prepared in the same manner as in the preparation of Crystalline Polyester Dispersion Liquid 1, provided that Crystalline Polyester Resin 1 was replaced with Crystalline Polyester Resin 4.

—Synthesis of Organic Particle Emulsion—

A reaction vessel equipped with a stirring rod and a thermometer was charged with 683 parts by mass of water, 11 parts by mass of a sodium salt of sulfuric acid ester of methacrylic acid-ethylene oxide adduct (ELEMINOL RS-30, manufactured by Sanyo Chemical Industries, Ltd.), 138 parts by mass of styrene, 138 parts by mass of methacrylic acid and 1 part by mass of ammonium persulfate, and the resulting mixture was stirred for 15 minutes at 400 rpm to prepare a white emulsion. The obtained emulsion was heated until the internal system temperature reached 75° C., followed by reacted for 5 hours. Subsequently, a 1% by mass aqueous ammonium persulfate solution (30 parts by mass) was added to the reaction mixture, followed by aging for 5 hours at 75° C., to thereby prepare an aqueous dispersion liquid (Fine Particle Dispersion Liquid 1) of a vinyl resin (a copolymer of styrene/methacrylic acid/sodium salt of sulfuric acid ester of methacrylic acid ethylene oxide adduct).

The prepared Fine Particle Dispersion Liquid 1 was subjected to the measurement of a volume average particle diameter by a particle size distribution analyzer (LA-920, manufactured by Horiba, Ltd.). The volume average particle diameter thereof was 0.14 μm. Part of fine particle dispersion liquid 1 was dried to separate the resin component.

—Preparation of Aqueous Phase—

Water (990 parts by mass), 83 parts by mass of Particle Dispersion Liquid 1, 37 parts by mass of a 48.5% sodium dodecyldiphenyl ether disulfonate aqueous solution (ELEMINOL MON-7, product of Sanyo Chemical Industries Ltd.) and 90 parts by mass of ethyl acetate were mixed together and stirred to obtain an opaque white liquid, which was used as Aqueous Phase 1.

—Emulsification and Removal of Solvent—

A vessel was charged with 664 parts by mass of the prepared Pigment-Wax Dispersion Liquid 1, 109.4 parts by mass of the synthesized Prepolymer 1, 73.9 parts by mass of the prepared Crystalline Polyester Dispersion Liquid 1, and 4.6 parts by mass of the synthesized Ketimine Compound 1, the mixture was mixed for 1 minute at 5,000 rpm with a TK homomixer (manufactured by Tokushu Kika Kogyo Co., Ltd.). Thereafter, 1,200 parts by mass of Aqueous Phase 1 was added to the vessel, and the resulting mixture was mixed for 20 minutes at 13,000 rpm with the TK homomixer, to thereby produce Emulsified Slurry 1.

A vessel equipped with a stirrer and a thermometer was charged with Emulsified Slurry 1, followed by removing the solvent from the Emulsified Slurry 1 for 8 hours at 30° C. and aging for 4 hours at 45° C., to thereby produce Dispersion Slurry 1.

—Washing and Drying—

Dispersion Slurry 1 (100 parts by mass) was filtrated under reduced pressure and then subjected to a series of treatments (1) to (4) described below:

(1): ion-exchanged water (100 parts by mass) was added to the filtration cake, and the mixture was mixed with a TK homomixer (at 12,000 rpm for 10 minutes), followed by filtration;

(2): a 10% aqueous sodium hydroxide solution (100 parts by mass) was added to the filtration cake obtained in (1), and the mixture was mixed with a TK homomixer (at 12,000 rpm for 30 minutes) followed by filtration under reduced pressure;

(3): 10% hydrochloric acid (100 parts by mass) was added to the filtration cake obtained in (2), and the mixture was mixed with a TK homomixer (at 12,000 rpm for 10 minutes) followed by filtration; and (4): ion-exchanged water (300 parts by mass) was added to the filtration cake obtained in (3), and the mixture was mixed with a TK homomixer (at 12,000 rpm for 10 minutes), followed by filtration, and this operation was performed twice, to thereby produce Filtration Cake 1.

Filtration Cake 1 was dried with an air-circulating drier for 48 hours at 45° C., and was then passed through a sieve with a mesh size of 75 μm, to thereby prepare Toner 1-1.

The obtained Toner 1-1 had the volume average particle diameter (Dv) of 5.3 μm, number average particle diameter (Dn) of 4.7 μm, and Dv/Dn of 1.12.

Example 1-2

Toner 1-2 of Example 1-2 was produced in the same manner as in Example 1-1, provided that Crystalline Polyester Dispersion Liquid 1 was changed to Crystalline Polyester Dispersion Liquid 2 in the emulsification and removal of the solvent.

Example 1-3

Toner 1-3 of Example 1-3 was produced in the same manner as in Example 1-1, provided that in the production of the oil phase, the microcrystalline wax (Hi-mic-1090, manufactured by Nippon Seiro Co., Ltd., melting point: 68° C.) was replaced with microcrystalline wax (Be Square180 white, manufactured by TOYO ADL CORPORATION, melting point: 62° C.).

Example 1-4

Toner 1-4 of Example 1-4 was produced in the same manner as in Example 1-1, provided that the amount of Prepolymer 1 used in the emulsification and removal of solvent was changed from 109.4 parts by mass to 87.5 parts by mass.

Example 1-5

Toner 1-5 of Example 1-5 was produced in the same manner as in Example 1-1, provided that the amount of Prepolymer 1 used in the emulsification and removal of solvent was changed from 109.4 parts by mass to 127.6 parts by mass.

Example 1-6

Toner 1-6 of Example 1-6 was produced in the same manner as in Example 1-5, provided that in the production of the oil phase, the microcrystalline wax (Hi-mic-1090, manufactured by Nippon Seiro Co., Ltd., melting point: 68° C.) was replaced with microcrystalline wax (Be Square180 white, manufactured by TOYO ADL CORPORATION, melting point: 62° C.).

Example 1-7

Toner 1-7 of Example 1-7 was produced in the same manner as in Example 1-1, provided that in the emulsification and removal of solvent, Crystalline Polyester Dispersion Liquid 1 was replaced with Crystalline Polyester Dispersion Liquid 4.

Comparative Example 1-1

Toner 1-8 of Comparative Example 1-1 was produced in the same manner as in Example 1-1, provided that in the emulsification and removal of solvent, Crystalline Polyester Dispersion Liquid 1 was replaced with Crystalline Polyester Dispersion Liquid 3.

Comparative Example 1-2

Toner 1-9 of Comparative Example 1-2 was produced in the same manner as in Example 1-1, provided that in the production of oil phase, the microcrystalline wax (Hi-mic-1090, manufactured by Nippon Seiro Co., Ltd., melting point: 68° C.) was replaced with paraffin wax (HNP-9, manufactured by Nippon Seiro Co., Ltd., melting point: 76° C.).

Comparative Example 1-3

Toner 1-10 of Comparative Example 1-3 was produced in the same manner as in Example 1-1, provided that the amount of Prepolymer 1 used in the emulsification and removal of solvent was changed from 109.4 parts by mass to 58.3 parts by mass.

Comparative Example 1-4

Toner 1-11 of Comparative Example 1-4 was produced in the same manner as in Example 1-1, provided that the amount of Prepolymer 1 used in the emulsification and removal of solvent was changed from 109.4 parts by mass to 182.3 parts by mass.

Comparative Example 1-5

Toner 1-12 of Comparative Example 1-5 was produced in the same manner as in Example 1-1, provided that in the preparation of Crystalline Polyester Dispersion Liquid 1, the temperature of the seal liquid of the bead mill shaft was changed from 18° C. to 35° C.

—Treatment with External Additive—

To 100 parts by mass of each of the toner obtained, 0.7 parts by mass of hydrophobic silica and 0.3 parts by mass of hydrophobic titanium oxide were added and mixed by HENSCHEL MIXER to perform a treatment with external additives, to thereby produce external additive-treated toners from the above-prepared toners.

—Production of Developer—

Each of the external additive-treated toners (5% by mass) was mixed with 95% by mass of copper-zinc ferrite carrier coated with a silicone resin, and having the average particle diameter of 40 μm to thereby prepare developers.

Various characteristics of obtained toners and developers were evaluated in the following manner. The results are shown in Tables 2-1 and 2-2.

<Fixing Ability>

A fixing section of a copier MF 2200 (Ricoh Company Limited) was modified to employ a TEFLON (registered trade mark) roller as a fixing roller, and using the modified copier a printing test was performed with Type 6200 paper sheets (product of Ricoh Company, Ltd.).

Specifically, the cold offset temperature (the lowest fixing temperature) and the hot offset temperature (the highest fixing temperature) determined by varying the fixing temperature.

The evaluation conditions for the lowest fixing temperature were set as follows: linear velocity of paper feed: 120 mm/sec to 150 mm/sec, surface pressure: 1.2 kgf/cm$^2$ and nip width: 3 mm.

The evaluation conditions for the highest fixing temperature were set as follows: linear velocity of paper feeding: 50 mm/sec, surface pressure: 2.0 kgf/cm$^2$ and nip width: 4.5 mm.

—Evaluation Criteria for Lowest Fixing Temperature—

A: 110° C. or lower

B: Higher than 110° C., but 115° C. or lower

C: Higher than 115° C., but 120° C. or lower

D: Higher than 120° C.

—Evaluation Criteria for Highest Fixing Temperature—

A: 185° C. or higher

B: 175° C. or higher but lower than 185° C.

C: 170° C. or higher but lower than 175° C.

D: Lower than 170° C.

<Heat Resistance Storage Stability>

After storing each toner for 8 hours at 50° C., the toner was passed through a sieve of 42-mesh for 2 minutes, and a residual rate of the toner on the wire gauze was measured. Note that, the toner with the better heat resistance storage stability gives the smaller residual rate.

[Evaluation Criteria]

A: Residual rate of lower than 10%

B: Residual rate of 10% or higher, but lower than 20%

C: Residual rate of 20% or higher, but lower than 30%

D: Residual rate of 30% or higher

<Image Evaluation>

A supply bottle was filled with each toner, and stored for 4 weeks at 30° C. and 60% RH. The developer and the toner supply bottle were used for continuous printing of a solid image on 100 sheets, by means of an image forming apparatus (Imagio Neo 450 of Ricoh Company Limited) which could output 45 sheets (A4 size) per minute. The resulting images were evaluated based on the following criteria.

[Evaluation Criteria]

A: Uniform and excellent solid image

B: White line in the width of less than 0.3 mm was slightly observed, but it was not clearly shown in the solid image.

C: White line(s) in the width of 0.3 mm or more was observed, and white line was observed in the solid image on less than 20 sheets out of 100 sheets.

D: White line(s) in the width of 0.3 mm or more was observed, and white line was observed in the solid image on 20 sheets or more out of 100 sheets.

<Evaluation of Filming Properties>

As an evaluation of other members contaminated with the wax contained in the toner, an image having an imaging rate of 5% (a toner image to be printed had the area of 5% relative to an area of printing paper) was printed on 50,000 sheets using a digital full color composite machine (Imagio MP C5000, manufactured by Ricoh Company Limited). Thereafter, the conditions of the developing roller, or photoconductor, whether toner filming occurred thereon, were visually observed, and evaluated based on the following criteria.

[Evaluation Criteria]

A: No filming was observed.

B: Line-shaped filming was hardly recognized.

C: Line-shaped filming was recognized on part of the member.

D: Filming was observed on the entire member.

<Total Evaluation>

The evaluation results obtained from above were comprehensively evaluated based on the following criteria.

I: The evaluation results had 2 or more "A" and no "D".

II: the evaluation results had 1 or more "A" and no "D".

III: the evaluation results had 1 or more "D".

TABLE 2-1

| | Onset temperature X (° C.) | Endset temperature Y (° C.) | Y − X (° C.) | Volume average particle diameter Dv (μm) | Dv/Dn |
|---|---|---|---|---|---|
| Ex. 1-1 | 45 | 90 | 45 | 5.3 | 1.12 |
| Ex. 1-2 | 43 | 90 | 47 | 5.1 | 1.11 |
| Ex. 1-3 | 45 | 86 | 41 | 5.1 | 1.13 |
| Ex. 1-4 | 42 | 91 | 49 | 5.3 | 1.1 |
| Ex. 1-5 | 50 | 89 | 39 | 4.9 | 1.14 |
| Ex. 1-6 | 49 | 85 | 35 | 5.0 | 1.12 |
| Ex. 1-7 | 47 | 92 | 35 | 5.3 | 1.15 |
| Comp. Ex. 1-1 | 39 | 90 | 51 | 5.1 | 1.12 |
| Comp. Ex. 1-2 | 41 | 70 | 29 | 5.1 | 1.13 |
| Comp. Ex. 1-3 | 38 | 90 | 52 | 5.4 | 1.09 |
| Comp. Ex. 1-4 | 56 | 90 | 34 | 5.3 | 1.17 |
| Comp. Ex. 1-5 | 32 | 91 | 59 | 5.2 | 1.16 |

TABLE 2-2

| | Lowst fixing | | Highest fixing | | Heat resistance | | | |
|---|---|---|---|---|---|---|---|---|
| | Temp. (° C.) | Evaluation | Temp. (° C.) | Evaluation | storage stability | Image evaluation | Filming | Total evaluation |
| Ex. 1-1 | 110 | A | 185 | A | B | B | A | I |
| Ex. 1-2 | 105 | A | 175 | B | B | B | A | I |
| Ex. 1-3 | 105 | A | 180 | B | B | B | B | II |
| Ex. 1-4 | 115 | B | 175 | B | A | A | A | I |
| Ex. 1-5 | 105 | A | 185 | A | B | B | B | I |
| Ex. 1-6 | 110 | A | 180 | B | B | B | B | II |
| Ex. 1-7 | 115 | B | 190 | A | A | A | A | I |
| Comp. Ex. 1-1 | 110 | A | 165 | D | D | D | D | III |
| Comp. Ex. 1-2 | 130 | D | 180 | B | A | D | D | III |
| Comp. Ex. 1-3 | 110 | A | 145 | D | D | D | D | III |
| Comp. Ex. 1-4 | 135 | D | 185 | A | A | A | C | III |
| Comp. Ex. 1-5 | 105 | A | 180 | B | D | D | D | III |

Example 2-1

—Synthesis of Non-Crystalline Polyester Resin 2—

A two-necked flask, which had been heated and dried, was charged with 780 mole parts of polyoxypropylene(2,2)-2,2-bis(4-hydroxyphenyl)propane, 18 mole parts of polyoxyethylene(2,2)-2,2-bis(4-hydroxyphenyl)propane, 47 mole parts of terephthalic acid, 24 mole parts of fumaric acid, and 24 mole parts of n-dodecenyl succinic acid as raw materials, and dibutyl tin oxide as a catalyst, and heated while introducing nitrogen gas to maintain an inert atmosphere. Thereafter, the mixture was reacted to proceed to a condensation copolymerization reaction for 12 hours at 230° C., followed by gradually reducing the pressure at 230° C. to thereby synthesize Non-Crystalline Polyester Resin 2.

The obtained Non-Crystalline Polyester Resin 2 had the number average molecular weight (Mn) of 6,700, weight average molecular weight (Mw) of 17,400, glass transition temperature (Tg) of 61° C., and acid value of 14 mgKOH/g.

—Formulation of Toner Material—

Binder resin: Crystalline Polyester Resin 1 (8 parts by mass)

Binder resin: Non-Crystalline Polyester Resin 2 (86 parts by mass)

Colorant: Carbon black C-44 (manufactured by Mitsubishi Chemical Corporation, average particle diameter: 24 nm, BET specific surface area: 125 $m^2/g$) (7 parts by mass)

Charge controlling agent (CCA): BONTRON E-84 (manufactured by ORIENT CHEMICAL INDUSTRIES CO., LTD) (1 part by mass)

Microcrystalline wax: Hi-mic-1090 (manufactured by Nippon Seiro Co., Ltd., melting point: 68° C.) (6 parts by mass)

Using a super mixer (SMV-200, manufactured by KAWATA MFG Co. Ltd.), the materials of the formulation above were sufficiently mixed, to thereby obtain a mixture of the material for the toner, i.e. a toner material. The obtained toner material was supplied to Buss cokneader (TCS-100, Buss) through a raw material supplying hopper, and was kneaded at the feeding rate of 120 kg/h.

The obtained kneaded product was rolled and cooled, and then roughly grinded by a hammer mill, followed by fine grinding by means of jet flow grinder (I-20 Jet Mill, manufactured by Nippon Pneumatic Mfg. Co., Ltd.). Thereafter, the resultant was subjected to classification of a fine powder by means of a wind classifier (DS-20, DS-10 separator, manufactured by Nippon Pneumatic Mfg. Co., Ltd.). Then, the obtained product from the classification was left to stand for 24 hours at 50° C. for annealing. In this manner, Toner 2-1 of Example 2-1 was produced.

Example 2-2

Toner 2-2 of Example 2-2 was produced in the same manner as in Example 2-1, provided that the microcrystalline wax (Hi-mic-1090, manufactured by Nippon Seiro Co., Ltd., melting point: 68° C.) in the toner material was replaced with microcrystalline wax (Be Square180 white, manufactured by TOYO ADL CORPORATION, melting point: 62° C.).

Comparative Example 2-1

Toner 2-3 of Comparative Example 2-1 was produced in the same manner as in Example 2-1, provided that the microcrystalline wax (Hi-mic-1090, manufactured by Nippon Seiro Co., Ltd., melting point: 68° C.) in the toner material was replaced with paraffin wax (HNP-9, manufactured by Nippon Seiro Co., Ltd., melting point: 76° C.).

Comparative Example 2-2

Toner 2-4 of Comparative Example 2-2 was produced in the same manner as in Example 2-1, provided that the annealing (standing for 24 hours at 50° C.) was not performed.

—Treatment with External Additive—

To 100 parts by mass of each of the toner obtained, 0.7 parts by mass of hydrophobic silica and 0.3 parts by mass of hydrophobic titanium oxide were added and mixed by HENSCHEL MIXER to perform a treatment with external additives, to thereby produce external additive-treated toners from the above-prepared toners.

—Production of Developer—

Each of the external additive-treated toners (5% by mass) was mixed with 95% by mass of copper-zinc ferrite carrier coated with a silicone resin, and having the average particle diameter of 40 μm to thereby prepare developers.

Various characteristics of each of the obtained toners and developers were evaluated in the same manner as in Examples 1-1 to 1-7 and Comparative Examples 1-1 to 1-5. The results are shown in Tables 3-1 to 3-2.

TABLE 3-1

| | Onset temperature X (° C.) | Endset temperature Y (° C.) | Y − X (° C.) | Volume average particle diameter Dv (μm) | Dv/Dn |
|---|---|---|---|---|---|
| Ex. 2-1 | 54 | 90 | 36 | 6.1 | 1.25 |
| Ex. 2-2 | 49 | 91 | 42 | 6.3 | 1.26 |
| Comp. Ex. 2-1 | 50 | 75 | 25 | 6.2 | 1.25 |
| Comp. Ex. 2-2 | 27 | 88 | 61 | 6.5 | 1.27 |

TABLE 3-2

| | Lowst fixing | | Highest fixing | | Heat resistance | | | |
|---|---|---|---|---|---|---|---|---|
| | Temp. (° C.) | Evaluation | Temp. (° C.) | Evaluation | storage stability | Image evaluation | Filming | Total evaluation |
| Ex. 2-1 | 110 | A | 185 | A | B | B | B | I |
| Ex. 2-2 | 115 | B | 175 | B | A | A | B | I |
| Comp. Ex. 2-1 | 130 | D | 180 | B | A | D | D | III |
| Comp. Ex. 2-2 | 110 | A | 175 | B | D | D | C | III |

Example 3-1

—Preparation of Crystalline Polyester Dispersion Liquid 5—

A stainless steel beaker was charged with 180 parts of Crystalline Polyester Resin 1, and 585 parts of deionized water, and the mixture was heated to 95° C. by placing the beaker in a hot bath.

When Crystalline Polyester Resin 1 was dissolved in water and the solution became clear, a 1% ammonium water was added to the solution to adjust pH thereof to 7.0 while stirring at 10,000 rpm by means of T.K. ROBOMIX (manufactured by PRIMIX Corporation). Subsequently, emulsification dispersion was performed by adding 20 parts by mass of an aqueous solution obtained by diluting a mixture of 0.8 parts by mass of an anionic surfactant (NEOGEN R-K, manufactured by Dai-ichi Kogyo Seiyaku Co., Ltd.) and 0.2 parts by mass of a nonionic emulsifier (EMULGEN 950, manufactured by Kao Corporation) dropwise, to thereby Prepare Crystalline Polyester Dispersion Liquid 5 (solids content: 11.9% by mass) having the volume average particle diameter of 0.22 μM.

—Preparation of Non-Crystalline Polyester Dispersion Liquid 2—

Non-Crystalline Polyester Dispersion Liquid 2 (solids content: 12.3% by mass) was prepared in the same manner as in the preparation of Crystalline Polyester Dispersion Liquid 5, provided that Crystalline Polyester Resin 1 was replaced with Non-Crystalline Polyester Resin 2.

—Preparation of Pigment Dispersion Liquid—

A vessel was charged with 20 parts by mass of carbon black (MA100S, manufactured by Mitsubishi Chemical Corporation), 80 parts by mass of ion-exchanged water, and 4.0 parts by mass of an anionic surfactant (NEOGEN R-K, manufactured by Dai-ichi Kogyo Seiyaku Co., Ltd.), and the pigment was dispersed by means of a bead mill (ULTRA VISCOMILL, manufactured by AIMEX CO., Ltd.) under the following conditions: a liquid feed rate of 1 kg/hr, disc circumferential velocity of 6 m/s, 0.3 mm-zirconium beads packed to 80% by volume, and 15 passes, to thereby obtain Pigment Dispersion Liquid 1 (solids content: 19.8% by mass) having the volume average particle diameter of 0.07 μm.

—Preparation of Wax Dispersion Liquid—

Wax (Hi-mic-1090, Nippon Seiro Co., Ltd., melting point: 68° C.) (20 parts), 80 parts of ion-exchanged water, and 4 parts of an anionic surfactant (NEOGEN R-K, manufactured by Dai-ichi Kogyo Seiyaku Co., Ltd.) were mixed together and the mixture was heated to 95° C. while stirring and the temperature was maintained at 95° C. for 1 hour. Thereafter, the resultant was cooled, and the wax was dispersed therein by means of a bead mill (ULTRA VISCOMILL, manufactured by AIMEX CO., Ltd.) under the following conditions: a liquid feed rate of 1 kg/hr, disc circumferential velocity of 6 m/s, 0.3 mm-zirconium beads packed to 80% by volume, and 25 passes, to thereby prepare Wax Dispersion Liquid 1 (solids content: 20.8% by mass) having the volume average particle diameter of 0.15 μm.

—Preparation of Charge Controlling Agent (CCA) Dispersion Liquid—

A vessel was charged with 5 parts by mass of a charge controlling agent (CCA) (BONTRON E-84, manufactured by Orient Chemical Industries Co., Ltd.), 95 parts by mass of ion-exchanged water, and 0.5 parts by mass of an anionic surfactant (NEOGEN R-K, manufactured by Dai-ichi Kogyo Seiyaku Co., Ltd.), and the charge controlling agent was dispersed therein by means of a bead mill (ULTRA VISCOMILL, manufactured by AIMEX CO., Ltd.) under the following conditions: a liquid feed rate of 1 kg/hr, disc circumferential velocity of 6 m/s, 0.3 mm-zirconium beads packed to 80% by volume, and 5 passes, to thereby obtain Charge Controlling Agent (CCA) Dispersion Liquid 1 (solids content: 4.8% by mass).

<Preparation Method of Toner>

The following components were mixed and stirred for 2 hours at 25° C. by means of a disperser.

| | |
|---|---|
| Pigment Dispersion Liquid 1 | 35.4 parts by mass |
| Charge Controlling Agent (CCA) Dispersion Liquid 1 | 20.8 parts by mass |
| Crystalline Polyester Dispersion Liquid 5 | 67.2 parts by mass |
| Non-Crystalline Polyester Dispersion Liquid 2 | 634.1 parts by mass |
| Wax Dispersion Liquid 1 | 28.8 parts by mass |

The resulting dispersion liquid was heated up to 60° C., and the pH thereof was adjusted to 7.0 with ammonium. Then, the dispersion liquid was further heated to 90° C., and the temperature was maintained for 6 hours. Thereafter, the dispersion liquid was cooled to 50° C., and the temperature was maintained for 24 hours at 50° C. to perform annealing, to thereby obtain Dispersion Slurry 2.

Dispersion Slurry 2 (100 parts) was filtrated under reduced pressure and then subjected a series of treatments (1) to (3) described below:

(1): ion-exchanged water (100 parts) was added to the filtration cake, followed by mixing with a TK homomixer (at 12,000 rpm for 10 minutes) and then filtration;

(2): 10% hydrochloric acid was added to the filtration cake obtained in (1) to adjust the pH thereof to 2.8, followed by mixing with a TK homomixer (at 12,000 rpm for 10 minutes) and then filtration; and (3): ion-exchanged water (300 parts) was added to the filtration cake obtained in (2), followed by mixing with a TK homomixer (at 12,000 rpm for 10 minutes) and then filtration, and this operation was performed twice, to thereby produce Filtration Cake 2.

Filtration Cake 2 was dried with an air-circulating drier at 45° C. for 48 hours, and then was passed through a sieve with a mesh size of 75 μm, to thereby prepare Toner 3-1 having the volume average particle diameter Dvof 5.9 μm, and Dv/Dn of 1.17.

Example 3-2

Toner 3-2 of Example 3-2 was produced in the same manner as in Example 3-1, provided that in the preparation of wax dispersion liquid, the microcrystalline wax (Hi-mic-1090, manufactured by Nippon Seiro Co., Ltd., melting point: 68° C.) was replaced with microcrystalline wax (Be Square180 white, manufactured by TOYO ADL CORPORATION, melting point: 62° C.).

Comparative Example 3-1

Toner 3-3 of Comparative Example 3-1 was produced in the same manner as in Example 3-1, provided that in the preparation of wax dispersion liquid, the microcrystalline wax (Hi-mic-1090, manufactured by Nippon Seiro Co., Ltd., melting point: 68° C.) was replaced with paraffin wax (HNP-9, manufactured by Nippon Seiro Co., Ltd., melting point: 76° C.).

Comparative Example 3-2

Toner 3-4 of Comparative Example 3-2 was produced in the same manner as in Example 3-1, provided that the annealing (standing for 24 hours at 50° C.) was not performed.

—Treatment with External Additive—

To 100 parts by mass of each of the toner obtained, 0.7 parts by mass of hydrophobic silica and 0.3 parts by mass of hydrophobic titanium oxide were added and mixed by HENSCHEL MIXER to perform a treatment with external additives, to thereby produce external additive-treated toners from the above-prepared toners.

—Production of Developer—

Each of the external additive-treated toners (5% by mass) was mixed with 95% by mass of copper-zinc ferrite carrier coated with a silicone resin, and having the average particle diameter of 40 μm to thereby prepare developers.

Various characteristics of each of the obtained toners and developers were evaluated in the same manner as in Examples 1-1 to 1-7 and Comparative Examples 1-1 to 1-5. The results are shown in Tables 4-1 to 4-2.

TABLE 4-1

| | Onset temperature X (° C.) | Endset temperature Y (° C.) | Y − X (° C.) | Volume average particle diameter Dv (μm) | Dv/Dn |
|---|---|---|---|---|---|
| Ex. 3-1 | 53 | 89 | 36 | 5.8 | 1.17 |
| Ex. 3-2 | 48 | 90 | 42 | 5.9 | 1.16 |
| Comp. Ex. 3-1 | 51 | 73 | 22 | 6.1 | 1.19 |
| Comp. Ex. 3-2 | 27 | 88 | 61 | 5.7 | 1.21 |

TABLE 4-2

| | Lowest fixing | | Highest fixing | | Heat resistance | | | |
|---|---|---|---|---|---|---|---|---|
| | Temp. (° C.) | Evaluation | Temp. (° C.) | Evaluation | storage stability | Image evaluation | Filming | Total evaluation |
| Ex. 3-1 | 110 | A | 185 | A | B | B | B | I |
| Ex. 3-2 | 115 | B | 175 | B | A | A | B | I |
| Comp. Ex. 3-1 | 130 | D | 180 | B | A | D | D | III |
| Comp. Ex. 3-2 | 110 | B | 175 | B | D | D | C | III |

The toner and developer of the present invention have excellent low temperature fixing ability and offset resistance, and are capable of forming high quality images with excellent sharpness over a long period without causing filming of a crystalline polyester resin. Therefore, the toner and developer can be suitably used in high quality electrophotographic image formations.

The invention claimed is:

1. A toner, comprising:

a binder resin;

a colorant;

a releasing agent having a melting point of 60° C. to 75° C.; and a crystalline polyester resin having a melting point of 60° C. to 80° C., wherein the toner satisfies Formulae (1), (2), and (3):

$$40° \text{ C.} \leq X \leq 55° \text{ C.} \quad \text{Formula (1),}$$

$$85° \text{ C.} \leq Y \leq 92° \text{ C.} \quad \text{Formula (2), and}$$

$$35° \text{ C.} \leq Y - X \leq 50° \text{ C.} \quad \text{Formula (3),}$$

wherein X is an onset temperature of an endothermic peak and Y is an endset temperature of the endothermic peak on a differential scanning calorimetry (DSC) curve of the toner as measured by a differential scanning calorimeter, and wherein the toner has an acid value of from 0.5 mgKOH/g to 40 mgKOH/g.

2. The toner according to claim 1, wherein the toner is obtained by a method comprising:

dispersing, in an aqueous medium, an oil phase comprising an organic solvent, and at least the crystalline polyester resin and a non-crystalline polyester resin dissolved or dispersed in the organic solvent, thereby obtaining an O/W dispersion liquid; and removing the organic solvent from the O/W dispersion liquid.

3. The toner according to claim 2, wherein the oil phase further comprises a binder resin precursor.

4. The toner according to claim 3, wherein the toner is obtained by a method comprising:

dispersing, in an aqueous medium comprising a dispersant, the oil phase comprising the organic solvent, and at least the colorant, the releasing agent, the crystalline polyester resin, a compound comprising an active hydrogen group, and the binder resin precursor, dissolved or dispersed in the organic solvent, thereby obtaining an emulsified dispersion liquid;

allowing the binder resin precursor and the compound to react in the emulsified dispersion liquid; and removing the organic solvent from the emulsified dispersion liquid, wherein the binder resin precursor comprises a site reactive to the compound.

5. The toner according to claim 1, wherein the toner is obtained by a method comprising:

melting and kneading a toner material comprising the crystalline polyester resin and a non-crystalline polyester resin, thereby obtaining a melt-kneaded product;

pulverizing the melt-kneaded product, thereby obtaining a pulverized product; and classifying the pulverized product.

6. The toner according to claim 5, wherein the method further comprises:

annealing at a temperature that is an onset temperature ±5° C., wherein the onset temperature is calculated from a DSC curve of the crystalline polyester resin as measured by a differential scanning calorimeter at an elevated temperature.

7. The toner according to claim 1, wherein the toner is obtained by a method comprising:

dispersing the crystalline polyester resin and a non-crystalline polyester resin in separate aqueous media to emulsify the crystalline polyester resin and the non-crystalline polyester resin as crystalline polyester resin particles and non-crystalline polyester resin particles, respectively;

mixing the crystalline polyester resin particles, the non-crystalline polyester resin particles, a releasing agent dispersion liquid in which the releasing agent is dispersed, and a colorant dispersion liquid in which the colorant is dispersed, thereby obtaining an aggregated particle dispersion liquid in which aggregated particles are dispersed; and heating the aggregated particle dispersion liquid to a temperature equal to or higher than a glass transition temperature of resin in the aggregated particles to fuse and combine the aggregated particles, thereby obtaining toner particles.

8. The toner according to claim 7, wherein the method further comprises:

annealing at an onset temperature ±5° C., wherein the onset temperature is calculated from a DSC curve of the crystalline polyester resin as measured by a differential scanning calorimeter at an elevated temperature.

9. The toner according to claim 1, wherein the toner satisfies:

$$10 \text{ mgKOH/g} < A < 40 \text{ mgKOH/g,}$$

$$0 \text{ mgKOH/g} < B < 20 \text{ mgKOH/g, and}$$

$$20 \text{ mgKOH/g} < A + B < 40 \text{ mgKOH/g,}$$

wherein A is an acid value of the crystalline polyester resin and B is a hydroxyl value of the crystalline polyester resin.

10. The toner according to claim 2, wherein the toner satisfies:

$$-10 \text{ mgKOH/g} < A - C < 10 \text{ mgKOH/g},$$

where A is an acid value of the crystalline polyester resin and C is an acid value of the non-crystalline polyester resin.

11. The toner according to claim 1, wherein the crystalline polyester resin is obtained from a C4-C12 saturated dicarboxylic acid and a C4-C12 saturated diol.

12. The toner according to claim 1, wherein a proportion of the crystalline polyester resin having a number average molecular weight of 500 or smaller is from 0% to 2% of the crystalline polyester resin, and a proportion of the crystalline polyester resin having a number average molecular weight of 1,000 or smaller is from 0% to 4% of the crystalline polyester resin.

13. The toner according to claim 1, wherein the releasing agent is at least one selected from the group consisting of microcrystalline wax, paraffin wax, and ester wax.

14. A developer, comprising:

a toner, comprising a binder resin, a colorant, a releasing agent having a melting point of 60° C. to 75° C., and a crystalline polyester resin having a melting point of 60° C. to 80° C., wherein the toner satisfies Formulae (1), (2), and (3):

$$40° \text{ C.} \leq X \leq 55° \text{ C.} \quad \text{Formula (1)},$$

$$85° \text{ C.} \leq Y \leq 92° \text{ C.} \quad \text{Formula (2), and}$$

$$35° \text{ C.} \leq Y - X \leq 50° \text{ C.} \quad \text{Formula (3)},$$

wherein X is an onset temperature of an endothermic peak and Y is an endset temperature of the endothermic peak on a differential scanning calorimetry (DSC) curve of the toner as measured by a differential scanning calorimeter, wherein the toner has an acid value of from 0.5 mgKOH/g to 40 mgKOH/g.

15. An image forming method, comprising:

forming an image with a toner, comprising a binder resin, a colorant, a releasing agent having a melting point of 60° C. to 75° C., and a crystalline polyester resin having a melting point of 60° C. to 80° C., wherein the toner satisfies Formulae (1), (2), and (3):

$$40° \text{ C.} \leq X \leq 55° \text{ C.} \quad \text{Formula (1)},$$

$$85° \text{ C.} \leq Y \leq 92° \text{ C.} \quad \text{Formula (2), and}$$

$$35° \text{ C.} \leq Y - X \leq 50° \text{ C.} \quad \text{Formula (3)},$$

wherein X is an onset temperature of an endothermic peak and Y is an endset temperature of the endothermic peak on a differential scanning calorimetry (DSC) curve of the toner as measured by a differential scanning calorimeter, wherein the toner has an acid value of from 0.5 mgKOH/g to 40 mgKOH/g.

* * * * *